US005663029A

United States Patent [19]

Malhotra

[11] Patent Number: 5,663,029

[45] Date of Patent: Sep. 2, 1997

[54] ELECTROSTATIC IMAGING PROCESS

[75] Inventor: Shadi L. Malhotra, Mississauga, Canada

[73] Assignee: Xerox Corporation, Stamford, Conn.

[21] Appl. No.: 590,660

[22] Filed: Jan. 24, 1996

[51] Int. Cl.[6] ..... G03G 13/16

[52] U.S. Cl. ..... 430/126; 428/195

[58] Field of Search ..... 428/412, 195, 428/480; 430/126

[56] References Cited

U.S. PATENT DOCUMENTS

| | | | |
|---|---|---|---|
| 3,488,189 | 1/1970 | Mayer et al. | 96/1.5 |
| 3,493,412 | 2/1970 | Johnston et al. | 117/17.5 |
| 3,561,337 | 2/1971 | Mulkery | 95/1 |
| 3,619,279 | 11/1971 | Johnston | 117/155 UA |
| 4,526,847 | 7/1985 | Walker et al. | 430/18 |
| 4,956,225 | 9/1990 | Malhotra | 428/216 |
| 4,997,697 | 3/1991 | Malhotra | 428/195 |
| 5,006,407 | 4/1991 | Malhotra | 428/336 |
| 5,118,570 | 6/1992 | Malhotra | 428/474.4 |
| 5,139,903 | 8/1992 | Malhotra | 430/18 |
| 5,145,749 | 9/1992 | Matthew | 428/511 |
| 5,202,205 | 4/1993 | Malhotra | 430/17 |
| 5,244,714 | 9/1993 | Malhotra et al. | 428/195 |
| 5,302,439 | 4/1994 | Malhotra et al. | 428/195 |
| 5,451,458 | 9/1995 | Malhotra | 428/412 |
| 5,451,466 | 9/1995 | Malhotra | 428/500 |

*Primary Examiner*—John Goodrow
*Attorney, Agent, or Firm*—Judith L. Byorick

[57] ABSTRACT

Disclosed is a process for generating images which comprises (1) generating an electrostatic latent image on an imaging member in an imaging apparatus; (2) developing the latent image; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of more than about 65° C. and a boiling point of more than about 150° C. and selected from the group consisting of (A) furan compounds; (B) pyrone and pyran compounds; (C) dioxane compounds; (D) aromatic anhydrides; (E) aromatic esters; (F) alkoxy compounds; (G) methylene dioxy compounds; (H) quinone compounds; and (I) mixtures thereof; (c) an optional filler; (d) an optional antistatic agent; and (e) an optional biocide.

25 Claims, No Drawings

ELECTROSTATIC IMAGING PROCESS

BACKGROUND OF THE INVENTION

The present invention is directed to electrostatic imaging processes. More specifically, the present invention is directed to imaging processes employing a recording substrate particularly suitable for use with dry and liquid electrostatic developers. One embodiment of the present invention is directed to a process for generating images which comprises (1) generating an electrostatic latent image on an imaging member in an imaging apparatus; (2) developing the latent image; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of more than about 65° C. and a boiling point of more than about 150° C. and selected from the group consisting of (A) furan compounds; (B) pyrone and pyran compounds; (C) dioxane compounds; (D) aromatic anhydrides; (E) aromatic esters; (F) alkoxy compounds; (G) methylene dioxy compounds; (H) quinone compounds; and (I) mixtures thereof; (c) an optional filler; (d) an optional antistatic agent; and (e) an optional biocide.

U.S. Pat. No. 5,118,570 (Malhotra) and U.S. Pat. No. 5,006,407 (Malhotra), the disclosures of each of which are totally incorporated herein by reference, disclose a transparency which comprises a hydrophilic coating and a plasticizer, which plasticizer can, for example, be from the group consisting of phosphates, substituted phthalic anhydrides, glycerols, glycols, substituted glycerols, pyrrolidinones, alkylene carbonates, sulfolanes, and stearic acid derivatives.

U.S. Pat. No. 5,145,749 (Matthew) discloses erasable coatings for xerography paper which comprise a pigment such as calcium carbonate in a binder such as an aqueous emulsion of an acrylic polymer. The erasability of the coating is improved by replacing at least 15 weight percent of the binder with a polyalkane or polyalkene wax, such as an aqueous emulsion of a polyolefin.

U.S. Pat. No. 4,526,847 (Walker et al.) discloses a transparency for the formation of an adherent electrostatic image thereon which includes a polyester resin film sheet having an image-receiving coating of nitrocellulose, a plasticizer, a particulate material, and, preferably, an antistatic agent. The coating is applied to the film sheet from a solvent mixture of an aliphatic ester or an aliphatic ketone, and an aliphatic alcohol.

U.S. Pat. No. 3,619,279 (Johnston et al.) discloses a toner receiving member having available at an external surface a solid crystalline plasticizer to reduce the fusion power requirements when toner is fused to the receiving member. The external surface of the toner receiving member is substantially free of material plasticizable by the solid crystalline plasticizer. Typically a plasticizer such as ethylene glycol dibenzoate may be available on the surface of paper.

U.S. Pat. No. 3,561,337 (Mulkey) discloses a sheet material having a transparent backing coated with a layer containing a polymeric binder and particles of solid material which is insoluble in the binder. The refractive index of the solid material varies from that of the binder by at most ±0.6. The surface of the layer is ink receptive and, by printing on that surface, a transparency is obtained.

U.S. Pat. No. 3,493,412 (Johnston et al.) discloses an imaging process wherein an electrostatic latent image is developed with a thermoplastic resin toner on an imaging surface and the toner image is transferred to an image receiving surface carrying an amount of a solid crystalline plasticizer sufficient to lower the toner fusion requirements when the toner image is fused to the receiving surface.

U.S. Pat. No. 3,488,189 (Mayer et al.) discloses the formation of fused toner images on an imaging surface corresponding to an electrostatic field by depositing on the imaging surface in image configuration toner particles containing a thermoplastic resin, the imaging surface carrying a solid crystalline plasticizer having a lower melting point than the melting range of the thermoplastic resin and heat fusing the resulting toner image.

U.S. Pat. No. 4,956,225 (Malhotra) discloses a transparency suitable for electrographic and xerographic imaging which comprises a polymeric substrate with a toner receptive coating on one surface thereof comprising blends selected from the group consisting of: poly(ethylene oxide) and carboxymethyl cellulose; poly(ethylene oxide), carboxymethyl cellulose, and hydroxypropyl cellulose; poly (ethylene oxide) and vinylidene fluoride/hexafluoropropylene copolymer; poly(chloroprene) and poly(alpha-methylstyrene); poly(caprolactone) and poly (alpha-methylstyrene); poly(vinyl isobutyl ether) and poly (alpha-methylstyrene); poly(caprolactone) and poly(p-isopropyl alpha-methylstyrene); blends of poly(1,4-butylene adipate) and poly(alpha-methylstyrene); chlorinated poly (propylene) and poly(alpha-methylstyrene); chlorinated poly(ethylene) and poly(alpha-methylstyrene); and chlorinated rubber and poly(alpha-methylstyrene). Also disclosed are transparencies with first and second coating layers.

U.S. Pat. No. 4,997,697 (Malhotra) discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. Pat. No. 5,202,205 (Malhotra), the disclosure of which is totally incorporated herein by reference, discloses a transparent substrate material for receiving or containing an image comprising a supporting substrate, an ink toner receiving coating composition on both sides of the substrate and comprising an adhesive layer and an antistatic layer contained on two surfaces of the adhesive layer, which antistatic layer comprises mixtures or complexes of metal halides or urea compounds both with polymers containing oxyalkylene segments.

U.S. Pat. No. 5,244,714 (Malhotra et al.), the disclosure of which is totally incorporated herein by reference, discloses a recording sheet which comprises a base sheet, an antistatic layer coated on at least one surface of the base sheet comprising a mixture of a first component selected from the group consisting of hydrophilic polysaccharides and a second component selected from the group consisting of poly (vinyl amines), poly (vinyl phosphates), poly (vinyl alcohols), poly (vinyl alcohol)-ethoxylated, poly (ethylene imine)-ethoxylated, poly (ethylene oxides), poly (n-vinyl acetamide-vinyl sulfonate salts), melamine-formaldehyde resins, urea-formaldehyde resins, styrene-vinylpyrrolidone copolymers, and mixtures thereof, and at least one toner receiving layer coated on an antistatic layer comprising a material selected from the group consisting of maleic anhydride containing polymers, maleic ester containing polymers, and mixtures thereof.

U.S. Pat. No. 5,302,439 (Malhotra et al.), the disclosure of which is totally incorporated herein by reference, discloses a recording sheet which comprises (a) a substrate; (b) a coating on the substrate which comprises a binder and a material having a melting point of less than about 65° C. and a boiling point of greater than 150° C. and selected from the group consisting of alkyl phenones, alkyl ketones, halogenated alkanes, alkyl amines, alkyl anilines, alkyl diamines, alkyl alcohols, alkyl diols, halogenated alkyl alcohols, alkane alkyl esters, saturated fatty acids, unsaturated fatty acids, alkyl aldehydes, alkyl anhydrides, alkanes, and mixtures thereof; (c) an optional traction agent; and (d) an optional antistatic agent.

U.S. Pat. No. 5,451,458 (Malhotra), the disclosure of which is totally incorporated herein by reference, discloses a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan derivatives; (2) cyclic ketones; (3) lactones; (4) cyclic alcohols; (5) cyclic anhydrides; (6) acid esters; (7) phosphine oxides; and (8) mixtures thereof; (c) an optional filler; (d) an optional antistatic agent; and (e) an optional biocide. Also disclosed is a process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan derivatives; (2) cyclic ketones; (3) lactones; (4) cyclic alcohols; (5) cyclic anhydrides; (6) acid esters; (7) esters; (8) phenones; (9) phosphine oxides; and (10) mixtures thereof; (c) an optional filler; (d) an optional antistatic agent; and (e) an optional biocide.

U.S. Pat. No. 5,451,466 (Malhotra), the disclosure of which is totally incorporated herein by reference, discloses a recording sheet which comprises (a) a substrate; (b) a coating on the substrate which comprises (i) a binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; and (I) mixtures thereof; (c) an optional filler; (d) an optional antistatic agent; and (e) an optional biocide. Also disclosed is a process for generating images which comprises (1) generating an electrostatic latent image on an imaging member in an imaging apparatus; (2) developing the latent image with a toner which comprises a colorant and a resin selected from the group consisting of (A) copolymers of styrene and at least one other monomer; (B) copolymers containing acrylic monomers and at least one other monomer; and (C) mixtures thereof; and (3) transferring the developed image to a recording sheet which comprises (a) a substrate; (b) a coating on the substrate which comprises (i) a polymeric binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; (I) aliphatic amines; (J) aldehydes; (K) aldehyde derivatives; and (L) mixtures thereof; (c) an optional filler; (d) an optional antistatic agent; and (e) an optional biocide.

U.S. Pat. No. 5,139,903 (Malhotra) and U.S. Pat. No. 5,260,140 (Malhotra), the disclosures of each of which are totally incorporated herein by reference, disclose an imaged transparency comprising a supporting substrate, oil absorbing layers comprising chlorinated rubber, styrene-diene copolymers, alkylmethacrylate copolymers, ethylene-propylene copolymers, sodium carboxymethyl cellulose, or sodium carboxymethylhydroxyethyl cellulose, and ink receiving polymer layers comprising vinyl alcohol/vinyl acetate, vinyl alcohol/vinyl butyral, or vinyl alcohol/vinyl acetate/vinyl chloride copolymers. The ink receiving layers may include therein or thereon fillers such as silica, calcium carbonate, or titanium dioxide.

Copending application U.S. Ser. No. 590,791, filed concurrently herewith, entitled "Electrostatic Imaging Process, ", with the named inventor Shadi L. Malhotra, the disclosure of which is totally incorporated herein by reference, discloses a process for generating images which comprises (1) generating an electrostatic latent image on an imaging member in an imaging apparatus; (2) developing the latent image; and (3) transferring the developed image to a recording sheet which comprises (a) a substrate; (b) a coating on the substrate which comprises (i) a polymeric binder selected from the group consisting of (A) copolymers of styrene and at least one other monomer; (B) copolymers of acrylic monomers and at least one other monomer; and (C) mixtures thereof; and (ii) an additive having a melting point of more than about 65° C. and a boiling point of more than about 150° C. and selected from the group consisting of (A) norbornane compounds; (B) phenyl compounds; and (C) mixtures thereof; (c) an optional filler; (d) an optional antistatic agent; and (e) an optional biocide.

While the above materials and processes are suitable for their intended purposes, a need remains for recording sheets particularly suitable for use in electrophotographic applications. In addition, a need remains for recording sheets which can be employed with electrostatic dry and/or liquid toners so that the heat and energy required for fusing the toner to the recording sheet is reduced. Further, a need remains for electrostatic imaging processes which employ electrostatic dry and/or liquid toners wherein jamming of the recording sheet in the fusing apparatus is reduced. Additionally, there is a need for electrostatic imaging processes with reduced fusing energy requirements and reduced jamming, wherein the imaged sheets also exhibit acceptable image quality and image fix to the recording sheet. There is also a need for recording sheets which can be employed with both electrostatic dry toners and electrostatic liquid developers. Further, a need remains for recording sheets having improved toner-wetting capability.

SUMMARY OF THE INVENTION

It is an object of the present invention to provide a recording sheet with the above advantages.

It is another object of the present invention to provide recording sheets particularly suitable for use in electrophotographic applications.

It is yet another object of the present invention to provide recording sheets which can be employed with electrostatic dry and/or liquid toners so that the heat and energy required for fusing the toner to the recording sheet is reduced.

It is still another object of the present invention to provide electrostatic imaging processes which employ electrostatic dry and/or liquid toners wherein jamming of the recording sheet in the fusing apparatus is reduced.

Another object of the present invention is to provide electrostatic imaging processes with reduced fusing energy requirements and reduced jamming, wherein the imaged sheets also exhibit acceptable image quality and image fix to the recording sheet.

Yet another object of the present invention is to provide recording sheets which can be employed with both electrostatic dry toners and electrostatic liquid developers.

Still another object of the present invention is to provide recording sheets having improved toner-wetting capability.

These and other objects of the present invention (or specific embodiments thereof) can be achieved by providing a process for generating images which comprises (1) generating an electrostatic latent image on an imaging member in an imaging apparatus; (2) developing the latent image; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of more than about 65° C. and a boiling point of more than about 150° C. and selected from the group consisting of (A) furan compounds; (B) pyrone and pyran compounds; (C) dioxane compounds; (D) aromatic anhydrides; (E) aromatic esters; (F) alkoxy compounds; (G) methylene dioxy compounds; (H) quinone compounds; and (I) mixtures thereof; (c) an optional filler; (d) an optional antistatic agent; and (e) an optional biocide.

DETAILED DESCRIPTION OF THE INVENTION

The recording sheets suitable for the process of the present invention comprise a substrate or base sheet having a coating on one or both surfaces thereof. Any suitable substrate can be employed. Examples of substantially transparent substrate materials include polyesters, including Mylar™, available from E. I. Du Pont de Nemours & Company, Melinex™, available from Imperial Chemicals, Inc., Celanar™, available from Celanese Corporation, polyethylene naphthalates, such as Kaladex PEN Films, available from Imperial Chemicals, Inc., polycarbonates such as Lexan™, available from General Electric Company, polysulfones, such as those available from Union Carbide Corporation, polyether sulfones, such as those prepared from 4,4'-diphenyl ether, such as Udel™, available from Union Carbide Corporation, those prepared from disulfonyl chloride, such as Victrex™, available from ICI Americas Incorporated, those prepared from biphenylene, such as Astrel™, available from 3M Company, poly (arylene sulfones), such as those prepared from crosslinked poly (arylene ether ketone sulfones), cellulose triacetate, polyvinylchloride cellophane, polyvinyl fluoride, polyimides, and the like, with polyester such as Mylar™ being preferred in view of its availability and relatively low cost. The substrate can also be opaque, including opaque plastics, such as Teslin™, available from PPG Industries, and filled polymers, such as Melinex™, available from ICI. Filled plastics can also be employed as the substrate, particularly when it is desired to make a "never-tear paper" recording sheet. Paper is also suitable, including plain papers such as Xerox® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company—Anatase grade AHR), calcium silicate CH-427-97-8, XP-974 (J. M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox® 4024™ papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

Coated on one or both surfaces of the base sheet is a coating. This coating can be either coated directly onto the base sheet or coated onto another layer of material coated onto the base sheet previously, such as an antistatic layer, an anticurl layer, or the like. This coating comprises (i) a binder selected from the group consisting of (A) polyesters; (B) polyvinyl acetals; (C) vinyl alcohol-vinyl acetal copolymers; (D) polycarbonates; and (E) mixtures thereof; and (ii) an additive having a melting point of more than about 65° C. and a boiling point of more than about 150° C. and selected from the group consisting of (A) furan compounds; (B) pyrone and pyran compounds; (C) dioxane compounds; (D) aromatic anhydrides; (E) aromatic esters; (F) alkoxy compounds; (G) methylene dioxy compounds; (H) quinone compounds; and (I) mixtures thereof. Optional components may also be present in the coating, such as an optional filler, an optional antistatic agent, an optional biocide, or the like.

Examples of suitable binder polymers include polyesters, such as polyester latexes, including as AQ-29D, available from Eastman Chemicals, poly(4,4-dipropoxy-2,2-diphenyl propane fumarate) #324, available from Scientific Polymer Products, poly(ethylene terephthalate) #138 and #418, available from Scientific Polymer Products, poly(ethylene succinate) #150, available from Scientific Polymer Products, poly(1,4-cyclohexane dimethylene succinate) #148, available from Scientific Polymer Products, or the like; polyvinyl acetate polymers, such as #346, #347, and #024, available from Scientific Polymer Products, or the like; vinylalcohol-vinyl acetate copolymers, such as those with a vinyl acetate content of about 91 percent by weight, including #379, available from Scientific Polymer Products, or the like; polycarbonates, such as #035, available from Scientific Polymer products, or the like; and the like, as well as mixtures thereof.

The coating composition also contains a non-polymeric material selected from the group consisting of furan compounds, pyrone and pyran compounds, coumarin compounds, dioxane compounds, aromatic anhydrides, aromatic esters, alkoxy compounds, methylene dioxy compounds, quinone compounds, and mixtures thereof.

Furan compounds are materials of the general formula

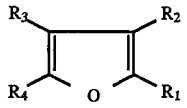

wherein $R_1$, $R_2$, $R_3$, and $R_4$ each, independently of one another, can be (but are not limited to) hydrogen, alkyl (including cyclic alkyl) groups, preferably with from 1 to about 40 carbon atoms, substituted alkyl groups, preferably with from 1 to about 40 carbon atoms and more preferably with from 1 to about 32 carbon atoms, aryl groups, preferably with from 6 to about 14 carbon atoms, substituted aryl groups, preferably with from 6 to about 16 carbon atoms, arylalkyl groups, preferably with from 7 to about 18 carbon atoms, substituted arylalkyl groups, preferably with from 7 to about 20 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, and $R_4$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, nitrogen, sulfur, or the like. Examples of suitable furan compounds include:

3-furoic acid (Aldrich F2,050-5), of the formula

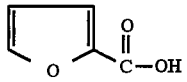

2,5-furandimethanol (Aldrich 19,461-1), of the formula

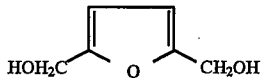

furylacrylic acid (Aldrich F2,080-7), of the formula

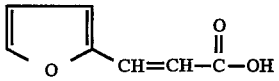

furil (Aldrich 13,802-9), of the formula

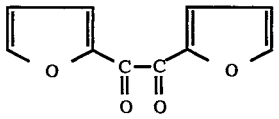

furoin (Aldrich 19,265-1), of the formula

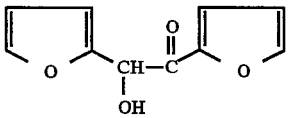

2-benzofuran carboxylic acid (Aldrich 30,727-0), of the formula

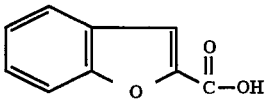

2,5-dimethyl-4-hydroxy-3(2H)-furanone (Aldrich 32,248-2), of the formula

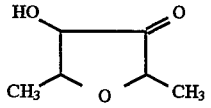

-continued 1,3-indanedione (Aldrich 1-200-2), of the formula

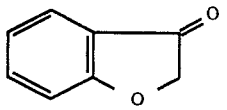

dibenzofuran (Aldrich 13,568-2), of the formula

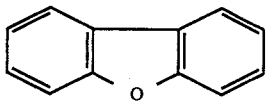

1,3-diphenylisobenzofuran (Aldrich 10,548-1), of the formula

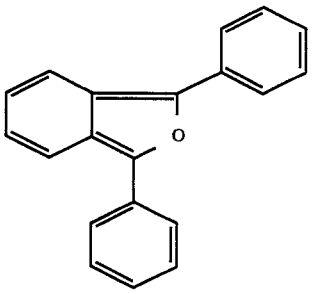

5-methoxy psoralen (Aldrich 27,572-7), of the formula

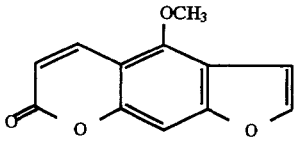

8-methoxypsoralen (Aldrich 23,272-6), of the formula

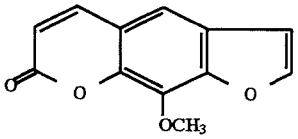

4,5',8-trimethylpsorlen (Aldrich 86,139-1), of the formula

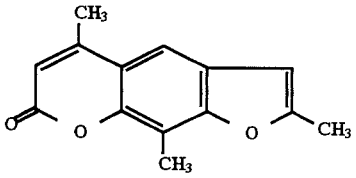

usnic acid (Aldrich 32,996-7), of the formula

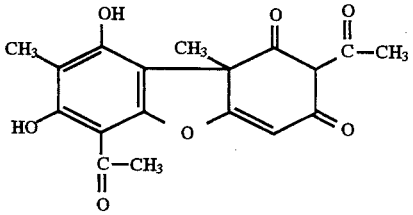

and the like, as well as mixtures thereof.

Pyran compounds are those of the general formulae

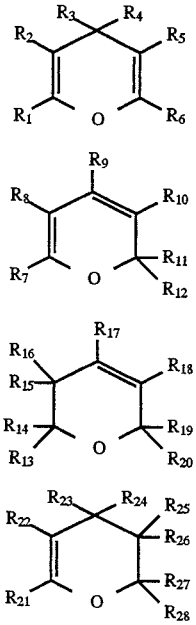

wherein $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, and $R_{28}$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, and $R_{28}$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, nitrogen, sulfur, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof. Pyrones are specific instances of compounds of the above formulae wherein at least one R group is an oxygen atom with a double bond to a ring carbon; in some instances, however, pyrones do not have double bonds between carbon atoms in the oxygen-containing six-membered ring.

Examples of pyran compounds include 3-hydroxy-2-methyl-4-pyrone (Aldrich H4,341-5), of the formula

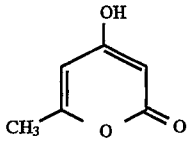

4-methoxy-6-methyl-2H-pyran-2-one (Aldrich 15,428-8), of the formula

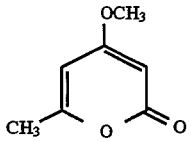

6,7-dimethoxy-3-isochromanone (Aldrich 30,280-5), of the formula

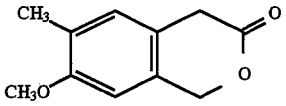

esculetin (Aldrich 24,657-3), of the formula

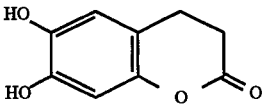

4-methylesculetin (Aldrich 11,990-3), of the formula

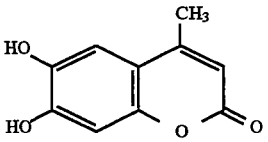

2,6-dimethyl-γ-pyrone (Aldrich D18,340-7), of the formula

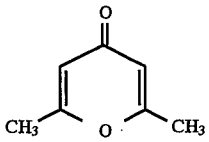

3,4-dihydro-2,2-dimethyl-4-oxo-2H-pyran-6-carboxylic acid (Aldrich 19,572-3), of the formula -continued

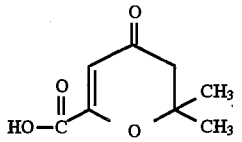

3,5-diacetyl tetrahydropyran-2,4,6-trione (Aldrich 23,080-4), of the formula

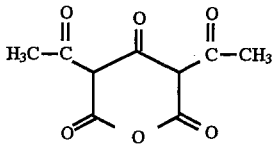

4-oxo-4H-1-benzopyran-2-carboxylic acid (Aldrich 18,978-2), of the formula

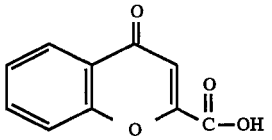

2,2-dimethyl-7-ethoxy-6-methoxy-4-chromanone (Aldrich 29,623-6), of the formula

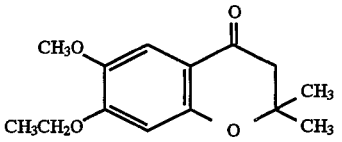

6,7-dimethoxy-2,2-dimethyl-4-chromanone (Aldrich 30,063-2), of the formula

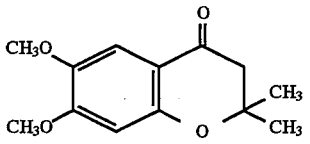

flavanone (Aldrich 10,203-2), of the formula

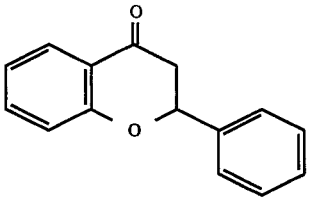

flavone (Aldrich F60-2), of the formula

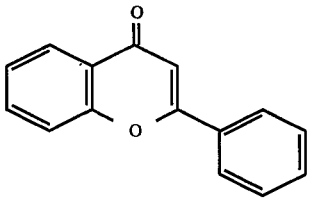

3-hydroxyflavone (Aldrich 26,171-8), of the formula

-continued

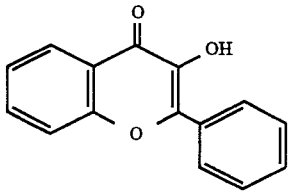

7-hydroxyflavone (Aldrich 26,172-6), of the formula

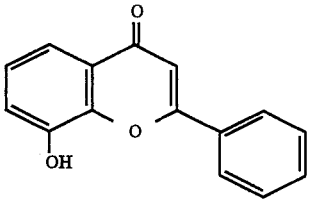

chrysin (Aldrich C8,010-5), of the formula

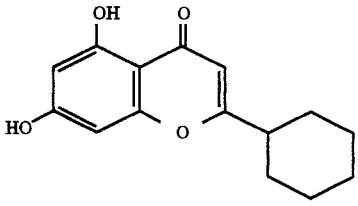

biochanin A (Aldrich 14,563-7), of the formula

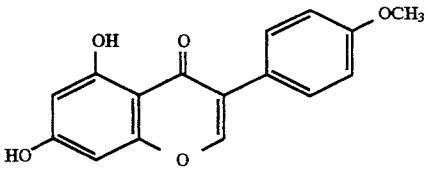

2-carbethoxy-5,7-dihydroxy-4'-methoxyiso-flavone (Aldrich C330-8), of the formula

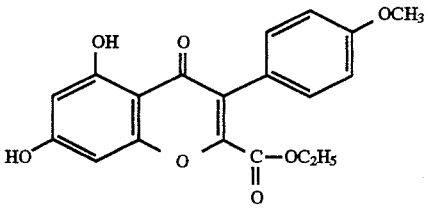

α-napthoflavone (Aldrich N180-1), of the formula

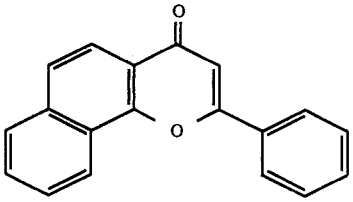

β-naphthoflavone (Aldrich N182-8), of the formula

-continued

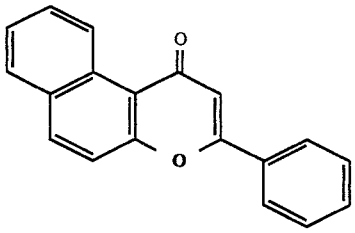

visnagin (4-methoxy-7-methyl-5H-furo[3,2-g][1]-benzopyran-5-one) (Aldrich 25,493-2), of the formula

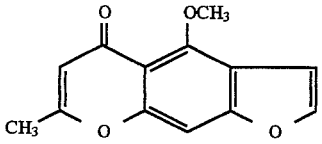

trolox (6-hydroxy-2,5,7,8-tetramethyl chroman-2-carboxylic acid) (Aldrich 23,881-3), of the formula

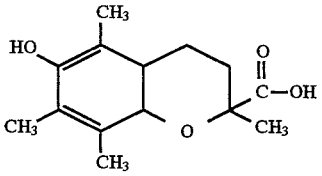

4',5'-dinitrofluorescein (Aldrich 35,882-7), of the formula

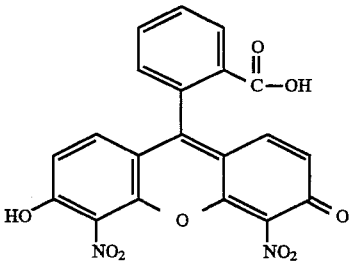

coumarin compounds, such as coumarin (Aldrich C8,555-7), of the formula

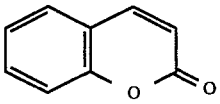

4-hydroxycoumarin (Aldrich H2,380-5), of the formula

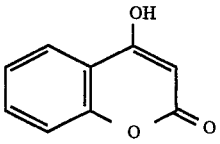

7-hydroxycoumarin (Aldrich H2,400-3), of the formula

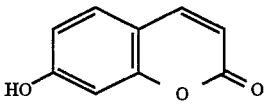

7-ethoxycoumarin (Aldrich 19,564-2), of the formula

-continued

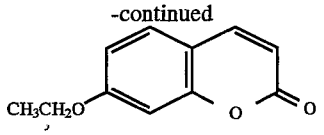

3-acetyl coumarin (Aldrich 21,467-1), of the formula

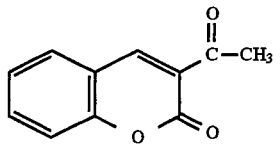

courmarin-3-carboxylic acid (Aldrich C8,560-3), of the formula

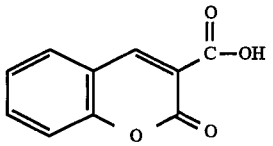

7-methoxy coumarin (Aldrich 22,033-7), of the formula

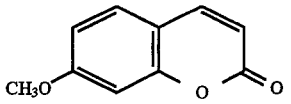

7-methoxy coumarin-4-acetic acid (Aldrich 23,529-9), of the formula

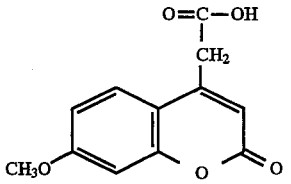

5,7-dimethoxy coumarin (Aldrich 11,623-8)

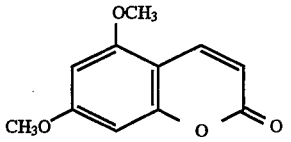

6,7-dimethoxy coumarin (Aldrich 25,488-6), of the formula

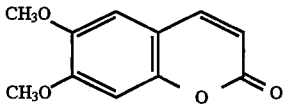

6-amino-3,4-benzocoumarin (Aldrich 30,023-3), of the formula

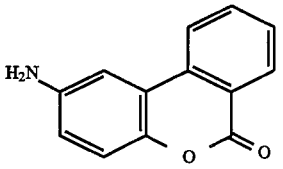

7-hydroxy-4-methyl coumarin (Aldrich 12,872-4), of the formula

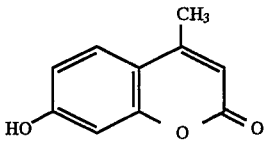

7-acetoxy-4-(bromoethyl) coumarin (Aldrich 29,856-5), of the formula

-continued

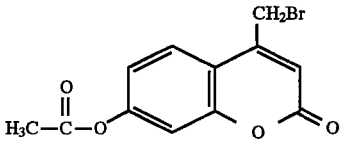

7-(carboxymethoxy)-4-methyl coumarin (Aldrich 29,855-7), of the formula

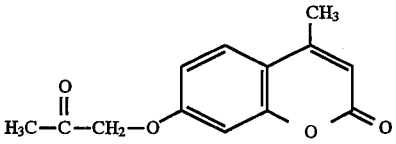

D,L-3-(α-acetonyl-4-chlorobenzyl)-4-hydroxy coumarin (Aldrich 18,921-9), of the formula

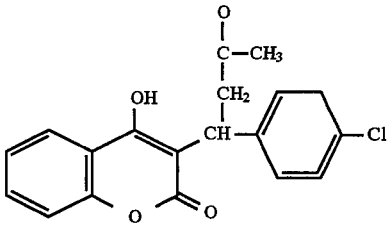

6,7-dimethyxy-4-methylcoumarin (Aldrich 31,640-7), of the formula

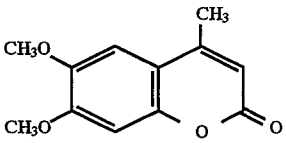

7,8-dihydroxy-6-methoxycoumarin (Aldrich 25,491-6), of the formula

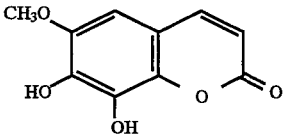

6,7-diacetoxy-4-methylcoumarin (Aldrich 31,744-6), of the formula

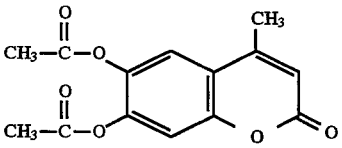

4-(bromomethyl)-6,7-dimethoxycoumarin (Aldrich 30,145-0), of the formula

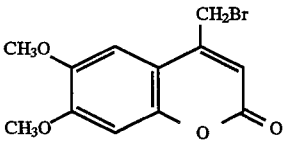

4,6-dimethyl-7-(ethylamino) coumarin (Aldrich D15,750-3), of the formula

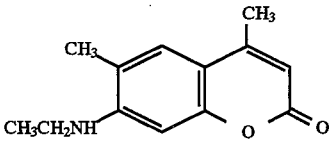

-continued 3-chloro-4-methyl-7-hydroxycoumarin (Aldrich 24,813-4), of the formula

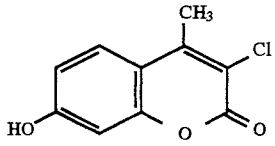

(±)-[3-(α-acetonylbenzyl)-4-hydroxycoumarin (Aldrich 25,801-6), of the formula

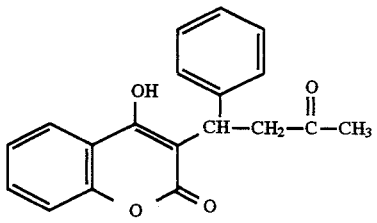

7-hydroxy-3,4,8-trimethylcoumarin (Aldrich 29,351-2), of the formula

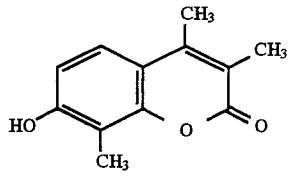

dicumarol (Aldrich 21,893-6), of the formula

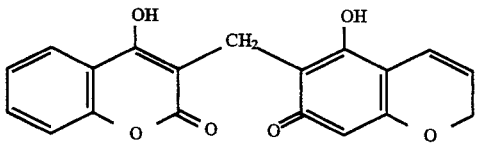

and the like, as well as mixtures thereof.

Dioxane compounds are those of the general formulae

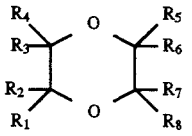

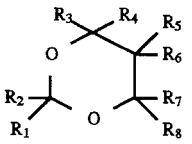

wherein $R_1$, $R_2$, $R_3$, $R_4$, $R_5$, $R_6$, $R_7$, and $R_8$ each, independently of the others, can be (but are not limited to) hydrogen atoms, alkyl groups, preferably with from 1 to about 6 carbon atoms and more preferably with from 1 to about 3 carbon atoms, substituted alkyl groups, preferably with from 1 to about 12 carbon atoms and more preferably with from 1 to about 6 carbon atoms, aryl groups, preferably with from about 6 to about 24 carbon atoms and more preferably with from about 6 to about 12 carbon atoms, substituted aryl groups, preferably with from about 6 to about 30 carbon atoms and more preferably with from about 6 to about 18 carbon atoms, arylalkyl groups, preferably with from about 7 to about 31 carbon atoms and more preferably with from about 7 to about 20 carbon atoms, substituted arylalkyl groups, preferably with from about 7 to about 32 carbon atoms and more preferably with from about 7 to about 21 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of $R_1$, $R_2$, $R_3$, $R_4$, $R_5$, $R_6$, $R_7$, and $R_8$ can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, nitrogen, sulfur, or the like. These compounds can also be in acid salt form, wherein they are associated with a compound of the general formula $xH_nY_n^-$, wherein n is an integer of 1, 2, or 3, x is a number indicating the relative ratio between compound and acid (and may be a fraction), and Y is an anion, such as $Cl^-$, $Br^-$, $I^-$, $HSO_4^-$, $SO_4^{2-}$, $NO_3^-$, $HCOO^-$, $CH_3COO^-$, $HCO_3^-$, $CO_3^{2-}$, $H_2PO_4^-$, $HPO_4^{2-}$, $PO_4^{3-}$, $SCN^-$, $BF_4^-$, $ClO_4^-$, $SSO_3^-$, $CH_3SO_3^-$, $CH_3C_6H_4SO_3^-$, $SO_3^{2-}$, $BrO_3^-$, $IO_3^-$, $ClO_3^-$, or the like, as well as mixtures thereof.

Examples of suitable dioxanes include 3,6-dimethyl-1,4-dioxane-2,5-dione (Aldrich 30,314-3), of the formula

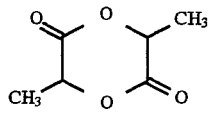

2,2-dimethyl-1,3-dioxane-4,6-dione (Aldrich 21,014-5), of the formula

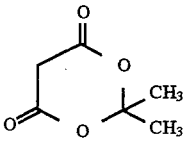

2,2,5-trimethyl-1,3-dioxane-4,6-dione (Aldrich 21,015-3), of the formula

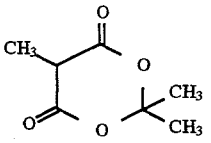

2,2-dimethyl-5-phenyl-1,3-dioxane-4,6-dione (Aldrich 22,522-3), of the formula

-continued

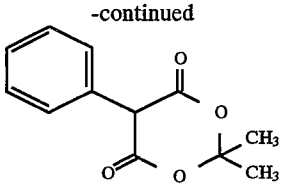

and the like, as well as mixtures thereof.

Aromatic anhydrides generally are compounds wherein a ring structure contains an oxygen atom as part of the ring and both carbons directly adjacent to the oxygen atom are joined to oxygen atoms by double bonds. The ring may also have substituents thereon, including situations wherein two or more substituents are joined together to form another ring. The molecule exhibits aromaticity in that at least one aromatic group is present somewhere in the molecule. Examples of suitable substituents on the ring carbon atoms include alkyl groups, preferably with from 1 to about 40 carbon atoms, substituted alkyl groups, preferably with from 1 to about 40 carbon atoms, more preferably from 1 to about 32 carbon atoms, aryl groups, preferably with from about 6 to about 14 carbon atoms, substituted aryl groups, preferably with from about 6 to about 16 carbon atoms, arylalkyl groups, preferably with from about 7 to about 18 carbon atoms, substituted arylalkyl groups, preferably with from about 7 to about 20 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more of the substituents can be joined together to form a ring, and wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the ring carbon atoms and another atom, such as carbon, oxygen, nitrogen, sulfur, or the like.

Examples of suitable aromatic anhydrides include homophthalic anhydride (Aldrich 12,858-9), of the formula

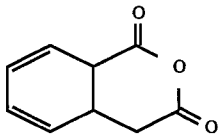

4-methyl phthalic anhydride (Aldrich 34,831-7), of the formula

-continued

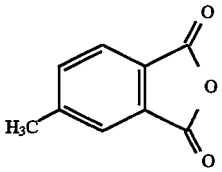

3-hydroxyphthalic anhydride (Aldrich 30,802-1), of the formula

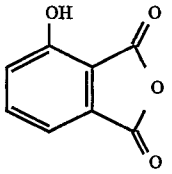

3-nitrophthalic anhydride (Aldrich 15,688-4), of the formula

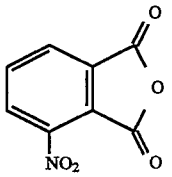

1,2,4-benzene tricarboxylic anhydride (Aldrich B460-0), of the formula

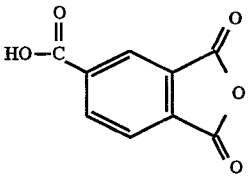

4-nitrophthalic anhydride (Aldrich 23,820-1), of the formula

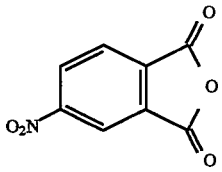

2-phenylglutaric anhydride (Aldrich P2,520-5), of the formula

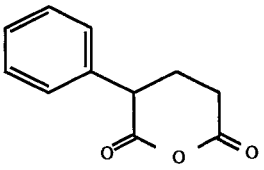

2,3-diphenylmaleic anhydride (Aldrich 29,415-2), of the formula

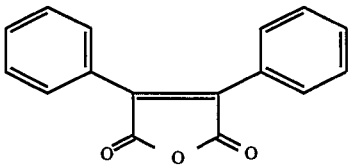

diphenic anhydride (Aldrich 14,890-3), of the formula

-continued

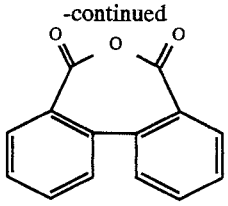

1,8-naphthalic anhydride (Aldrich N160-7), of the formula

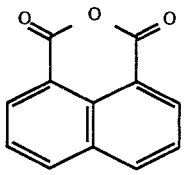

4-nitro-1,8-naphthalic anhydride (Aldrich 32,434-5), of the formula

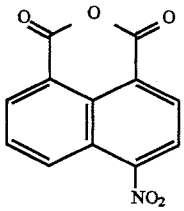

3-nitro-1,8-naphthalic anhydride (Aldrich N1,900-1), of the formula

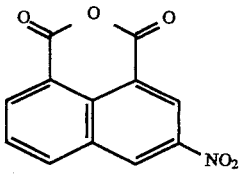

4-bromo-1,8-naphthalic anhydride (Aldrich 32,424-8), of the formula

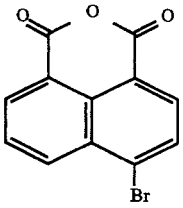

4-chloro-1,8-naphthalic anhydride (Aldrich 19,149-3), of the formula

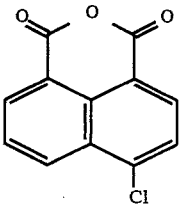

1,2,4,5-benzene tetracarboxylic dianhydride (Aldrich B402-3) of the formula

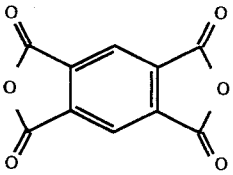

1,4,5,8-naphthalene tetracarboxylic dianhydride (Aldrich N81-8), of the formula

-continued

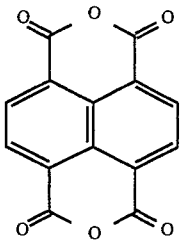

3,3',4,4'-benzophenone tetracarboxylic dianhydride (Aldrich B975-0), of the formula

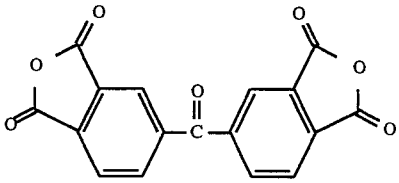

and the like, as well as mixtures thereof.

Alkoxy compounds are those of the general formula R'—OR, wherein R is an alkyl group, preferably with from 1 to about 25 carbon atoms and more preferably with from 1 to about 10 carbon atoms, and wherein R' is selected from the group consisting of alkyl groups, preferably with from 1 to about 25 carbon atoms, more preferably with from 1 to about 10 carbon atoms, substituted alkyl groups, preferably with from 1 to about 25 carbon atoms, more preferably with from 1 to about 20 carbon atoms, even more preferably with from 1 to about 10 carbon atoms, aryl groups, preferably with from about 6 to about 14 carbon atoms and more preferably with from about 6 to about 10 carbon atoms, substituted aryl groups, preferably with from about 6 to about 16 carbon atoms and more preferably with from about 6 to about 12 carbon atoms, arylalkyl groups, preferably with from about 7 to about 18 carbon atoms and more preferably with from about 7 to about 14 carbon atoms, and substituted arylalkyl groups, preferably with from about 7 to about 20 carbon atoms and more preferably with from about 7 to about 16 carbon atoms, wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the carbon atoms in R' and another atom, such as carbon, oxygen, nitrogen, sulfur, or the like.

Examples of suitable alkoxy compounds include 3-hydroxy-4-methoxy benzaldehyde (Aldrich 14,368-5), of the formula $HOC_6H_3(OCH_3)CHO$, vanillin (Aldrich V110-4), of the formula $(4\text{-}(HO)C_6H_3\text{-}3\text{-}(OCH_3)CHO$, vanillin acetate (4-formyl-2-methoxy phenyl acetate) (Aldrich 25,860-1), of the formula $CH_3COOC_6H_3(CHO)OCH_3$, 5-nitrovanillin (Aldrich N2,800-0), of the formula $O_2NC_6H_2\text{-}3(OCH_3)\text{-}4(OH)\text{-}CHO$, 6-nitro veratraldehyde (Aldrich 27,960-9), of the formula $O_2NC_6H_2$-3,4-$(OCH_3)_2CHO$, 3-ethoxy-4-hydroxy benzaldehyde (Aldrich 12,809-0), of the formula $C_2H_5OC_6H_3(OH)CHO$, syringaldehyde (4-hydroxy-3,5-dimethoxy-benzaldehyde) (Aldrich S760-2), of the formula 4-$(HO)C_6H_2$-3,5-$(OCH_3)_2CHO$, syringic acid (4-hydroxy-3,5-dimethoxy benzoic acid) (Aldrich S800-5), of the formula 4-$(HO)C_6H_2$-3,5-$(OCH_3)_2COOH$, 4-ethoxybenzoic acid (Aldrich 14,495-9), of the formula $C_2H_5OC_6H_4COOH$, 3-methoxy-4-methylbenzoic acid (Aldrich M1,505-2), of the formula $CH_3OC_6H_3(CH_3)COOH$, 1-(4-methoxy phenyl)-1-cyclohexane carboxylic acid (Aldrich 16,019-9), of the formula $CH_3OC_6H_4C_5H_{10}COOH$, 1-(4-methoxy phenyl)-1-cyclopentane carboxylic acid (Aldrich 16,015-6), of the formula $CH_3OC_6H_4C_5H_8COOH$, 4-ethoxy phenyl acetic acid (Aldrich 12,811-2), of the formula $C_2H_5OC_6H_4CH_2COOH$, 3-(2-methoxy phenyl) propionic acid (Aldrich M2,350-0), of the formula $CH_3OC_6H_4CH_2CH_2COOH$, 3-(4-methoxy phenyl) propionic acid (Aldrich M2,352-7), of the formula $CH_3OC_6H_4CH_2CH_2COOH$, 3-ethoxy-4-methoxybenzyl alcohol (Aldrich 30,790-4), of the formula $C_2H_5OC_6H_3(OCH_3)CH_2OH$, 3-hydroxy-4-methoxybenzyl alcohol (Aldrich 18,843-3), of the formula $HOC_6H_3(OCH_3)CH_2OH$, 2-ethoxy benzamide (Aldrich E440-2), of the formula $C_2H_5OC_6H_4CONH_2$, 5-methoxy-1-tetralone (Aldrich 11,311-5), of the formula

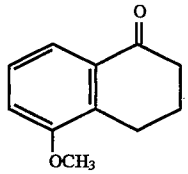

6-methoxy-1-tetralone (Aldrich M2,558-9), of the formula

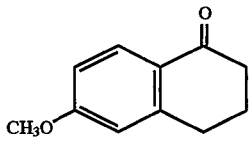

5-methoxy-1-indanone (Aldrich 18,353-9), of the formula

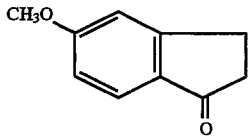

6-methoxy-1-indanone (Aldrich 17,525-0), of the formula

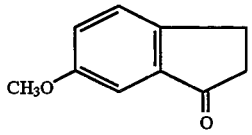

5,6-dimethoxy-1-indanone (Aldrich 14,782-6), of the formula

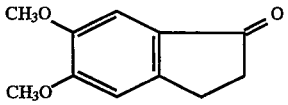

3-(3,4,5-trimethoxy phenyl) propionic acid (Aldrich 19,787-4), of the formula $(CH_3O)_3C_6H_2CH_2CH_2COOH$, 3,4,5-trimethoxy phenyl acetonitrile (Aldrich 11,336-0), of the formula $(CH_3O)_3C_6H_2CH_2CN$, 3,4,5-trimethoxy phenyl acetic acid (Aldrich T7,060-2), of the formula $(CH_3O)_3C_6H_2CH_2COOH$, 3,4,5-trimethoxy phenol (Aldrich 19,785-8), of the formula $(CH_3O)_3C_6H_2OH$, 3,4,5-trimethoxy cinnamic acid (Aldrich 7,040-8) and 2,4,5-trimethoxy cinnamic acid (Aldrich T7,039-4), both of the formula $(CH_3O)_3C_6H_2CH{=}CHCOOH$, 3,4,5-triethoxy benzoic acid (Aldrich 26,053-3), of the formula $(C_2H_5O)_3C_6H_2COOH$, 1,2,4-triacetoxy benzene (Aldrich 13,203-9), of the formula $(CH_3COO)_3C_6H_3$, 3',4',540 -trimethoxy acetophenone (Aldrich T6,810-1), of the formula $(CH_3O)_3C_6H_2COCH_3$, 3,4,5-trimethoxy aniline (Aldrich T6,820-9), of the formula $(CH_3O)_3C_6H_4NH_2$, 2,4,5-trimethoxy benzaldehyde (Aldrich 13,215-2), of the formula $(CH_3O)_3C_6H_2CHO$, 2,4,6-trimethoxy benzaldehyde (Aldrich 13,871-1), of the formula $(CH_3O)_3C_6H_2CHO$, 3,4,5-trimethoxy benzaldehyde (Aldrich T6,840-3), of the formula $(CH_3O)_3C_6H_2CHO$, 2,3,4-trimethoxy benzoic acid (Aldrich 18,979-0), 2,4,5-trimethoxy benzoic acid (Aldrich 13,889-4), and 3,4,5-trimethoxy benzoic acid (Aldrich T6,900-0), all of the formula $(CH_3O)_3C_6H_2COOH$, 2,4,6-trimethoxy benzonitrile (Aldrich 15,559-4) and 3,4,5-trimethoxy benzonitrile (Aldrich 13,261-0), both of the formula $(CH_3O)_3C_6H_2CN$, and the like.

Ester compounds are those of the general formula

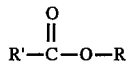

wherein R and R' each, independently of the others, is selected from the group consisting of alkyl groups, preferably with from 1 to about 40 carbon atoms and more preferably with from 1 to about 10 carbon atoms, substituted alkyl groups, preferably with from 1 to about 40 carbon atoms, more preferably with from 1 to about 32 carbon atoms, even more preferably with from 1 to about 16 carbon atoms, aryl groups, preferably with from about 6 to about 14 carbon atoms and more preferably with from about 6 to about 10 carbon atoms, substituted aryl groups, preferably with from about 6 to about 20 carbon atoms and more preferably with from about 6 to about 16 carbon atoms, arylalkyl groups, preferably with from about 7 to about 16 carbon atoms and more preferably with from about 7 to about 12 carbon atoms, and substituted arylalkyl groups, preferably with from about 7 to about 20 carbon atoms and more preferably with from about 7 to about 14 carbon atoms, wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein two or more substituents can be joined together to form a ring. Other variations are also possible, such as a double bond between one of the carbon atoms in R or R' and another atom, such as carbon, oxygen, nitrogen, sulfur, or the like.

Examples of suitable ester compounds include monomethyl phthalate (Aldrich 31,764-0), of the formula 2-$(HOOC)C_6H_4COOCH_3$, mono-methyl terephthalate (Aldrich 32,838-3), of the formula 4 $(HOOC)C_6H_4COOH_3$, dimethyl terephthalate (Aldrich 18,512-4), of the formula $C_6H_4$-1,4-$(COOCH_3)_2$, dimethyl aminoterephthalate (Aldrich 20,537-0), of the formula $H_2NC_6H_3$-1,4-$(COOCH_3)_2$, methyl benzilate (Aldrich 10,788-3), of the formula $(C_6H_5)_2C(OH)COOCH_3$, octyl gallate (Aldrich 28,962-0), of the formula 3,4,5-$(HO)_3C_6H_2COO(CH_2)_7CH_3$, L-tyrosine methyl ester (Aldrich T9,080-8), of the formula 4-$(HO)C_6H_4CH_2CH(NH_2)COOCH_3$, methyl o-methyl podocarpate (Aldrich 85,612-6), of the formula

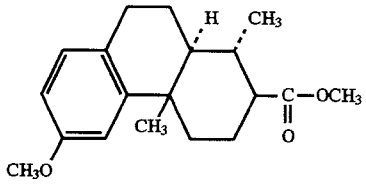

ethyl 4-hydroxy-6-methyl-2-oxo-3-cyclohexene-1-carboxylate (Aldrich 29,872-7), of the formula

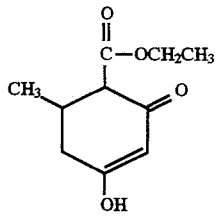

dimethyl 1,3-cyclohexadiene-1,4-dicarboxylate (Aldrich 30,158-2), of the formula

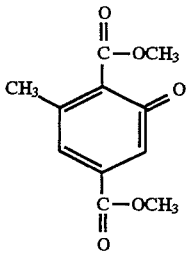

dimethyl 2,3-o-benzylidene-tartrate (Aldrich 29,644-9; 29,643-0), of the formula

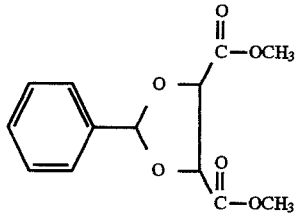

trimethyl 1,3,5-benzene-tricarboxylate (Aldrich 11,598-3), of the formula $C_6H_3(COOCH_3)_3$, pentamethyl cyclopentadiene-1,2,3,4,5-pentacarboxylate (Aldrich 30, 284-8), of the formula

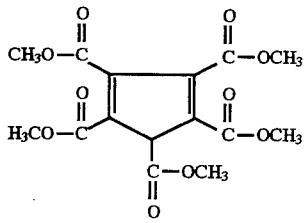

and the like.

Methylene dioxy compounds are those of the general formula

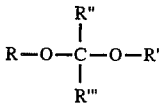

wherein R and R' each, independently of the other, are selected from the group consisting of alkyl groups, preferably with from 1 to about 25 carbon atoms and more preferably with from 1 to about 10 carbon atoms, substituted alkyl groups, preferably with from 1 to about 25 carbon atoms, more preferably with from 1 to about 20 carbon atoms, even more preferably with from 1 to about 10 carbon atoms, aryl groups, preferably with from about 6 to about 14 carbon atoms and more preferably with from about 6 to about 10 carbon atoms, substituted aryl groups, preferably with from about 6 to about 16 carbon atoms and more preferably with from about 6 to about 12 carbon atoms, arylalkyl groups, preferably with from about 7 to about 18 carbon atoms and more preferably with from about 7 to about 14 carbon atoms, and substituted arylalkyl groups, preferably with from about 7 to about 20 carbon atoms and more preferably with from about 7 to about 16 carbon atoms, and R" and R'" each, independently of the other, are selected from the group consisting of hydrogen atoms, alkyl groups, preferably with from 1 to about 25 carbon atoms and more preferably with from 1 to about 10 carbon atoms, substituted alkyl groups, preferably with from 1 to about 25 carbon atoms, more preferably with from 1 to about 20 carbon atoms, even more preferably with from 1 to about 10 carbon atoms, aryl groups, preferably with from about 6 to about 14 carbon atoms and more preferably with from about 6 to about 10 carbon atoms, substituted aryl groups, preferably with from about 6 to about 16 carbon atoms and more preferably with from about 6 to about 12 carbon atoms, arylalkyl groups, preferably with from about 7 to about 18 carbon atoms and more preferably with from about 7 to about 14 carbon atoms, substituted arylalkyl groups, preferably with from about 7 to about 20 carbon atoms and more preferably with from about 7 to about 16 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, and wherein two or more of R, R', R", and R'" can be joined together to form a ring. Other variations are also possible, such as a double bond between one of the carbon atoms in R, R', R", or R'" and another atom, such as carbon, oxygen, nitrogen, sulfur, or the like.

Examples of suitable dimethoxy compounds include 3',4'-(methylene dioxy)acetophenone (Aldrich 117,480-1), of the formula

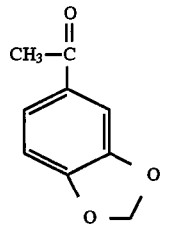

3,4-(methylene dioxy) cinnamic acid (Aldrich 14,624-2), of the formula

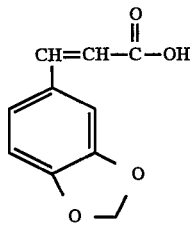

3,4-(methylene dioxy)-4-nitrobenzene (Aldrich 16,150-0), of the formula

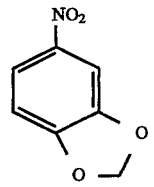

3,4-(methylene dioxy) phenylacetic acid (Aldrich 32,967-3), of the formula

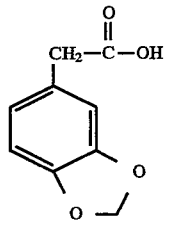

6-nitropiperonal (Aldrich 13.765-0), of the formula

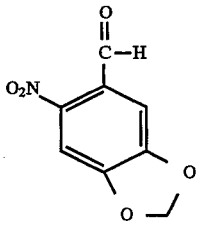

6-nitropiperonyl alcohol (Aldrich 19,629-0), of the formula

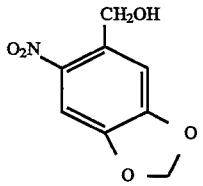

piperonylic acid (Aldrich P4,980-5), of the formula

-continued

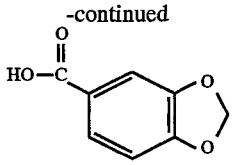

2,2-dihydroxy-5-methoxy-1,3-indandione (Aldrich 34,100-2), of the formula

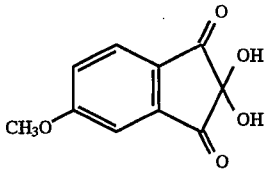

and the like.

Quinones are of the general formula

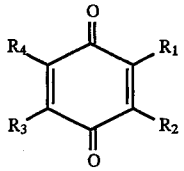

wherein $R_1$, $R_2$, $R_3$, and $R_4$ each, independently of the others, are selected from the group consisting of hydrogen atoms, alkyl groups, preferably with from 1 to about 25 carbon atoms and more preferably with from 1 to about 10 carbon atoms, substituted alkyl groups, preferably with from 1 to about 25 carbon atoms, more preferably with from 1 to about 20 carbon atoms, even more preferably with from 1 to about 10 carbon atoms, aryl groups, preferably with from about 6 to about 14 carbon atoms and more preferably with from about 6 to about 10 carbon atoms, substituted aryl groups, preferably with from about 6 to about 16 carbon atoms and more preferably with from about 6 to about 12 carbon atoms, arylalkyl groups, preferably with from about 7 to about 18 carbon atoms and more preferably with from about 7 to about 14 carbon atoms, substituted arylalkyl groups, preferably with from about 7 to about 20 carbon atoms and more preferably with from about 7 to about 16 carbon atoms, hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, wherein the substituents on the substituted alkyl groups, substituted aryl groups, and substituted arylalkyl groups can be (but are not limited to) hydroxy groups, amine groups, imine groups, ammonium groups, pyridine groups, pyridinium groups, ether groups, aldehyde groups, ketone groups, ester groups, amide groups, carboxylic acid groups, carbonyl groups, thiocarbonyl groups, sulfate groups, sulfonate groups, sulfide groups, sulfoxide groups, phosphine groups, phosphonium groups, phosphate groups, cyano groups, nitrile groups, mercapto groups, nitroso groups, halogen atoms, nitro groups, sulfone groups, acyl groups, acid anhydride groups, azide groups, and the like, and wherein two or more of $R_1$, $R_2$, $R_3$, and $R_4$ can be joined together to form a ring.

Examples of suitable quinones include hydroquinones, such as hydroquinone (Aldrich 24,012-5), of the formula $C_6H_4$-1,4-$(OH)_2$, methylhydroquinone (Aldrich 11,296-8), of the formula $CH_3C_6H_3$-1,4-$(OH)_2$, chlorohydroquinone (Aldrich 22,408-1), of the formula $ClC_6H_3$-1,4-$(OH)_2$, phenyl hydroquinone (Aldrich 22,781-1), of the formula $C_6H_4C_6H_3(OH)_2$, 2,3-dimethyl hydroquinone (Aldrich 30,075-6), of the formula $(CH_3)_2C_6H$-1,4-$(OH)_2$, 2,5-ditert-butyl hydroquinone (Aldrich 11,297-6), of the formula $[(CH_3)_3C]C_6H_2$-1,4-$(OH)_2$, hydroquinone bis (2-hydroxyethyl) ether (Aldrich 23,791-4), of the formula $C_6H_4(OCH_2CH_2OH)_2$, and the like; tetrahydroxy-1,4-benzoquinone hydrate (Aldrich T1,700-0), of the formula

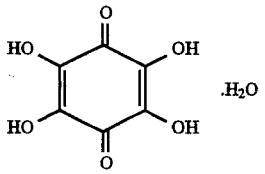

2,3-dimethoxy-5-methyl-1,4-benzoquinone (Aldrich 29,956-1), of the formula

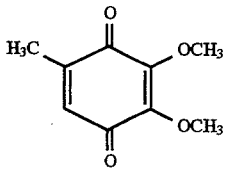

duroquinone (Aldrich D22,320-4), of the formula

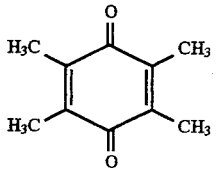

1,2-naphthoquinone (Aldrich 16,107-1), of the formula

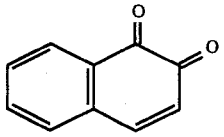

1,4-naphthoquinone (Aldrich 15,275-7), of the formula

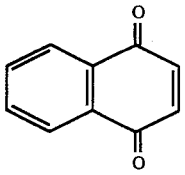

2-methyl-1,4-naphthoquinone (Aldrich M5,740-5), of the formula

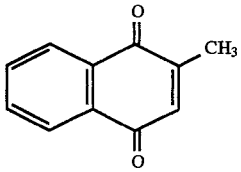

2,3-dimethyl-1,4-naphthaquinone (Aldrich 33,937-7), of the formula

-continued

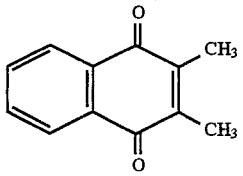

plumbagin (5-hydroxy-2-methyl-1,4-naphthoquinone) (Aldrich 19,064-0), of the formula

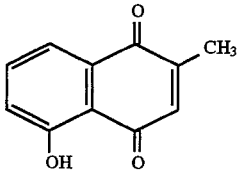

5,8-dihydroxy-1,4-naphthoquinone (Aldrich 23,252-1), of the formula

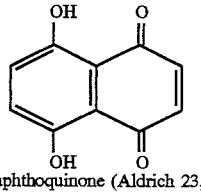

2-amino-3-chloro-1,4-naphthoquinone (Aldrich 23,666-7), of the formula

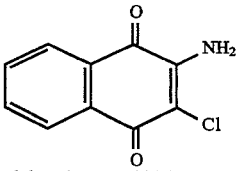

2,3-dichloro-1,4-naphthoquinone (Aldrich D6,720-0), of the formula

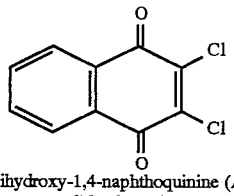

2,3-dichloro-5,8-dihydroxy-1,4-naphthoquinine (Aldrich 34,342-0), of the formula

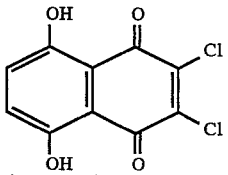

and the like; anthraquinones, such as anthraquinone (Aldrich A,900-4), of the formula

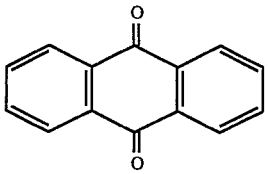

1,4,4a,9a-tetrahydro anthraquinone (Aldrich 23,667-5), of the formula

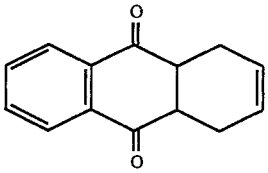

2-methyl anthraquinone (Aldrich 10,964-9), of the formula

-continued

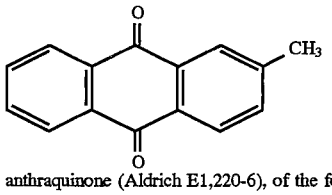

2-ethyl anthraquinone (Aldrich E1,220-6), of the formula

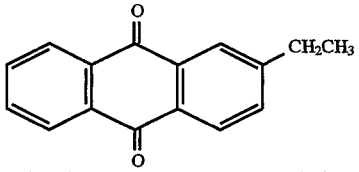

2-(tert-butyl) anthraquinone (Aldrich 10,823-5), of the formula

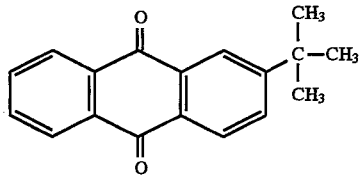

1-(methylamino) anthraquinone (Aldrich M2,820-0), of the formula

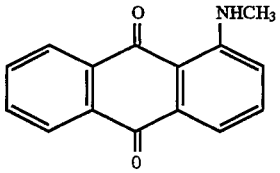

2-(hydroxy methyl) anthraquinone (Aldrich 22,652-1), of the formula

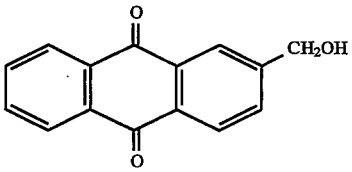

anthraquinone-2-carboxylic acid (Aldrich 25,272-7), of the formula

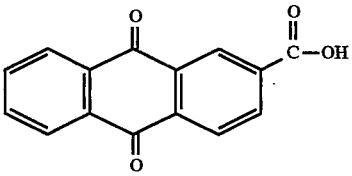

1-chloro anthraquinone (Aldrich C2,320-9), of the formula

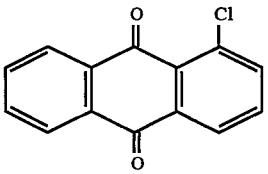

2-chloro anthraquinone (Aldrich 15,629-9), of the formula

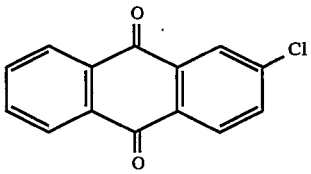

1-amino anthraquinone (Aldrich A3,900-9), of the formula

-continued

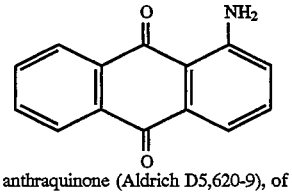

1,5-dichloro anthraquinone (Aldrich D5,620-9), of the formula

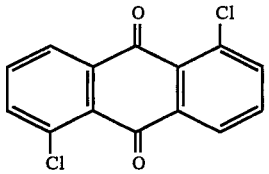

1,8-dichloro anthraquinone (Aldrich D5,640-3), of the formula

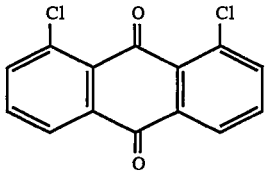

1,4-diamino anthraquinone (Aldrich D1,160-4), of the formula

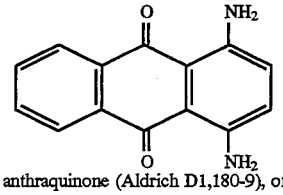

1,5-diamino anthraquinone (Aldrich D1,180-9), of the formula

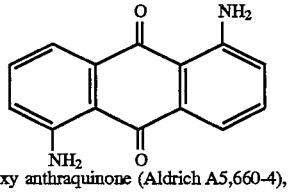

1-amino-4-hydroxy anthraquinone (Aldrich A5,660-4), of the formula

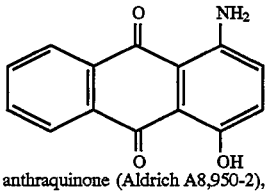

2,6-dihydroxy anthraquinone (Aldrich A8,950-2), of the formula

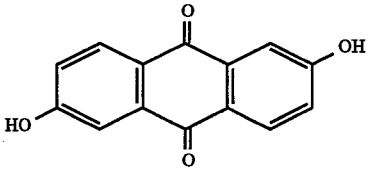

anthrarufin (Aldrich 34,001-4), of the formula

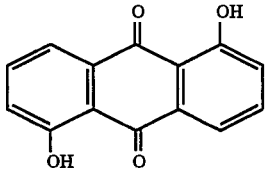

1-amino-4-bromo-2-methyl anthraquinone (Aldrich 24,669-7), of the formula

-continued

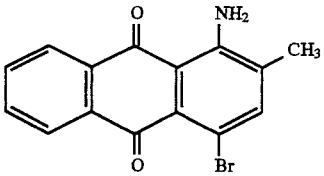

chrysophanic acid (Aldrich 22,907-5), of the formula

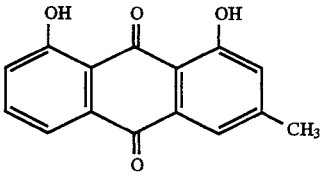

6,7-dichloro-1,4-dihydroxy anthraquinone (Aldrich 28,142-5), of the formula

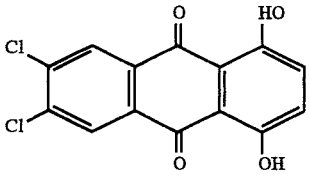

2,3-dimethyl quinzarin (Aldrich 25,520-3), of the formula

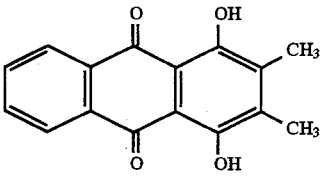

1,4-chrysene quinone (Aldrich 24,973-4), of the formula

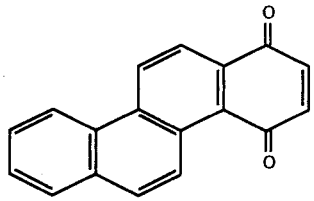

5,12-naphthacenequinone (Aldrich 19,877-3), of the formula

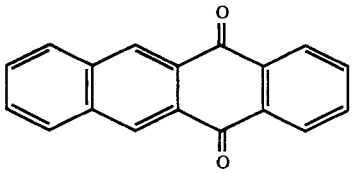

bianthrone (Aldrich B3,340-4), of the formula

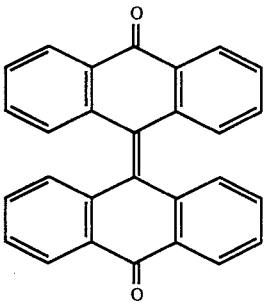

aceanthraquinone (Aldrich 32,797-2), of the formula

-continued

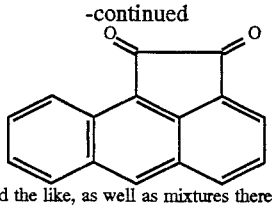

and the like, as well as mixtures thereof.

and the like, as well as mixtures thereof.

Mixtures of any two or more of the above additive materials can also be employed.

The additive material has a melting point of greater than 65° C. Preferably the additive has a melting point of greater than about 75° C., and more preferably has a melting point of greater than about 150° C. Preferably the additive has a melting point of less than about 300° C., and more preferably has a melting point of less than about 200° C., although the melting point may be outside the indicated ranges.

The binder can be present within the coating in any effective amount; typically the binder and the additive material are present in relative amounts of from about 10 percent by weight binder and about 90 percent by weight additive material to about 99 percent by weight binder and about 1 percent by weight additive material, although the relative amounts can be outside of this range.

In addition, the coating of the recording sheets of the present invention can contain optional filler components. Fillers can be present in any effective amount provided that the substantial transparency of the recording sheet is maintained in instances wherein the recording sheet is a transparency, and if present, typically are present in amounts of from about 0.5 to about 5.0 percent by weight of the coating composition. Examples of filler components include colloidal silicas, such as Syloid 74, available from Grace Company, titanium dioxide (available as Rutile or Anatase from NL Chem Canada, Inc.), hydrated alumina (Hydrad TMC-HBF, Hydrad TM-HBC, available from J. M. Huber Corporation), barium sulfate (K. C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blends of calcium fluoride and silica, such as Opalex-C available from Kemira. O. Y. zinc oxide, such as Zoco Fax 183, available from Zo Chem, blends of zinc sulfide with barium sulfate, such as Lithopane, available from Schteben Company, and the like, as well as mixtures thereof.

Further, the coating of the recording sheets of the present invention can contain optional antistatic components. Antistatic components can be present in any effective amount, and if present, typically are present in amounts of from about 0.5 to about 5.0 percent by weight of the coating composition. Examples of antistatic components include both anionic and cationic materials. Examples of anionic antistatic components include monoester sulfosuccinates, such as those of the general formula

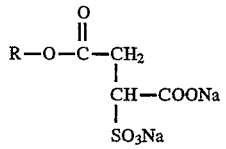

wherein R represents an alkanolamide or ethoxylated alcohol, diester sulfosuccinates, such as those of the general formula

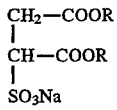

wherein R represents an alkyl group, and sulfosuccinamates, such as those of the general formula

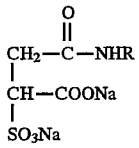

wherein R represents an alkyl group, all commercially available from Alkaril Chemicals as, for example, Alkasurf SS-L7DE, Alkasurf SS-L-HE, Alkasurf SS-OA-HE, Alkasurf SS-L9ME, Alkasurf SS-DA4-HE, Alkasurf SS-1B-45, Alkasurf SS-MA-80, Alkasurf SS-NO, Alkasurf SS-0-40, alkasurf SS-0-60PG, Alkasurf SS-0-70PG, Alkasurf SS-0-75, Alkasurf SS-TA, and the like. Examples of cationic antistatic components include diamino alkanes, such as those available from Aldrich Chemicals, quaternary salts, such as Cordex AT-172 and other materials available from Finetex Corp., and the like. Other suitable antistatic agents include quaternary acrylic copolymer latexes, particularly those of the formula

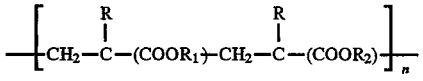

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as Cl, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like.

Also suitable as antistatic agents are quaternary choline halides. Examples of suitable quaternary choline halides include (1) choline chloride [(2-hydroxyethyl) trimethyl ammonium chloride] $HOCH_2CH_2N(CH_3)_3Cl$ (Aldrich 23,994-1) and choline iodide $HOCH_2CH_2N(CH_3)_3I$ (Aldrich C7,971-9); (2) acetyl choline chloride $CH_3COOCH_2CH_2N(CH_3)_3Cl$ (Aldrich 13,535-6), acetyl choline bromide $CH_3COOCH_2CH_2N(CH_3)_3Br$ (Aldrich 85,968-0), and acetyl choline iodide $CH_3COOCH_2CH_2N(CH_3)_3I$ (Aldrich 10,043-9); (3) acetyl-β-methyl choline chloride $CH_3COOCH(CH_3)CH_2N(CH_3)Cl$ (Aldrich A1,800-1) and acetyl-β-methyl choline bromide $CH_3COOCH(CH_3)CH_2N(CH_3)_3Br$ (Aldrich 85,554-5); (4) benzoyl choline chloride $C_6H_5COOCH_2CH_2N(CH_3)_3Cl$ (Aldrich 21,697-6); (5) carbamyl choline chloride $H_2NCOOCH_2CH_2N(CH_3)_3Cl$ (Aldrich C240-9); (6) D,L-carnitinamide hydrochloride $H_2NCOCH_2CH(OH)CH_2N(CH_3)_3Cl$ (Aldrich 24,783-9); (7) D,L-carnitine hydrochloride $HOOCCH_2CH(OH)CH_2N(CH_3)_3Cl$ (Aldrich C1,600-8); (8) (2-bromo ethyl) trimethyl ammonium chloride [bromo choline chloride] $BrCH_2CH_2N(CH_3)_3Br$ (Aldrich 11,719-6); (9) (2-chloro ethyl) trimethyl ammonium chloride [chloro choline chloride) $ClCH_2CH_2N(CH_3)_3Cl$ (Aldrich 23,443-5); (10) (3-carboxy propyl) trimethyl ammonium chloride $HOOC(CH_2)_3N(CH_3)_3Cl$ (Aldrich 26,365-6); (11) butyryl choline chloride $CH_3CH_2CH_2COOCH_2CH_2N(CH_3)_3Cl$ (Aldrich 85,537-5); (12) butyryl thiocholine iodide $CH_3CH_2CH_2COSCH_2CH_2N(CH_3)_3I$ (Aldrich B10,425-6); (13) S-propionyl thiocholine iodide $C_2H_5COSCH_2CH_2N(CH_3)I$ (Aldrich 10,412-4); (14) S-acetylthiocholine bromide $CH_3COSCH_2CH_2N(CH_3)_3Br$ (Aldrich 85,533-2) and S-acetylthiocholine iodide $CH_3COSCH_2CH_2N(CH_3)_3I$ (Aldrich A2,230-0); (15) suberyl dicholine dichloride $[—(CH_2)_3COOCH_2CH_2N(CH_3)_3Cl]_2$ (Aldrich 86,204-5) and suberyl dicholine diiodide $[—(CH_2)_3COOCH_2CH_2N(CH_3)_3I]_2$ (Aldrich 86,211-8); and the like, as well as mixtures thereof.

Additional examples of materials suitable as antistatic components include those disclosed in copending application Ser. Nos. 08/034,917, 08/034,943, 08/033,917, 08/034,445, and 08/033,918, the disclosures of each of which are totally incorporated herein by reference.

The antistatic agent can be present in any effective amount; typically, the antistatic agent is present in an amount of from about 1 to about 5 percent by weight of the coating, and preferably in an amount of from about 1 to about 2 percent by weight of the coating, although the amount can be outside these ranges.

Further, the coating of the recording sheets of the present invention can contain one or more optional biocides. Examples of suitable biocides include (A) non-ionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB, available from Buckman Laboratories Inc.); (3) methylene his (thiocyanate) (Metasol T-10, available from Calgon Corporation; AMA-110, available from Vinings Chemical Company; Vichem MBT, available from Vineland Chemical Company; Aldrich 10,509-0); (4) 2-bromo-4'-hydroxyacetophenone (Busan 90, available from Buckman Laboratories); (5) 1,2-dibromo-2,4-dicyano-butane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1,3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a non-ionic blend of a sulfone, such as bis (trichloromethyl) sulfone and methylene bisthiocyanate (available as SLIME-TROL RX-38A from Betz Paper Chem Inc.); (11) a non-ionic blend of methylene bisthiocyanate and bromonitrostyrene (available as SLIME-TROL RX-41 from Betz Paper Chem Inc.); (12) a non-ionic blend of 2-(thiocyanomethylthio) benzothiazole (53.2% by weight) and 2-hydroxypropyl methanethiosulfonate (46.8% by weight) (available as BUSAN 25 from Buckman Laboratories Inc.); (13) a non-ionic blend of methylene bis (thiocyanate) 50 percent by weight and 2-(thiocyanomethylthio) benzothiazole 50 percent by weight (available as BUSAN 1009, 1009WB from Buckman Laboratories Inc.); (14) a non-ionic blend of 2-bromo-4'-hydroxyacetophenone (70 percent by weight) and 2-(thiocyanomethylthio) benzothiazole (30 percent by weight) (BUSAN 93, available from Buckman Laboratories Inc.); (15) a non-ionic blend of 5-chloro-2-methyl-4-isothiazoline-3-one (75 percent by weight) and 2-methyl-4-isothiazolin-3-one (25 percent by weight), (available as AMERSTAT 250 from Drew Industrial Division; NALCON 7647, from NALCO Chemical Company;Kathon LY, from Rohm and Haas Co.); and the like, as well as mixtures thereof; (B) anionic biocides, such as (1) anionic potassium N-hydroxymethyl-N-methyl-dithiocarbamate (available as BUSAN 40 from Buckman Larboratories Inc.); (2) an anionic blend of N-hydroxymethyl-N-methyl dithiocarbamate (80% by weight) and sodium 2-mercapto benzothiazole (20% by weight) (available as BUSAN 52 from Buckman Laboratories Inc.); (3) an anionic blend of sodium dimethyl dithiocarbamate 50 percent by weight and (disodium ethylenebis-dithiocarbamate) 50% by weight (available as METASOL 300 from Calgon Corporation; AMERSTAT 272 from Drew Industrial Division; SLIME CONTROL F from Western Chemical Company); (4) an anionic blend of N-methyldithiocarbamate 60 percent by weight and disodium cyanodithioimidocarbonate 40 percent by weight (available as BUSAN 881 from Buckman Laboratories Inc); (5) An anionic blend of methylene bis-thiocyanate (33% by weight), sodium dimethyl-dithiocarbamate (33% by weight), and sodium ethylene bisdithiocarbamate (33% by weight) (available as AMERSTAT 282 from Drew Industrial Division; AMA-131 from Vinings Chemical Company); (6) sodium dichlorophene (G-4-40, available from Givaudan Corp.); and the like, as well as mixtures thereof; (C) cationic biocides, such as (1) cationic poly (oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl) sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

The coating composition of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25° to about 100° C. in an air drier.

Recording sheets of the present invention can be employed in printing and copying processes wherein dry or liquid electrophotographic-type developers are employed, such as electrophotographic processes, ionographic processes, or the like. Yet another embodiment of the present invention is directed to a process for generating images which comprises generating an electrostatic latent image on an imaging member in an imaging apparatus; developing the latent image with a toner; transferring the developed image to a recording sheet of the present invention; and optionally permanently affixing the transferred image to the recording sheet. Still another embodiment of the present invention is directed to an imaging process which comprises generating an electrostatic latent image on a recording sheet of the present invention; developing the latent image with a toner; and optionally permanently affixing the developed image to the recording sheet. Electrophotographic processes are well known, as described in, for example, U.S. Pat. No. 2,297,691 to Chester Carlson. Ionographic and electrographic processes are also well known, and are described in, for example, U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, and 4,155,093, the disclosures of each of which are totally incorporated herein by reference.

In a particularly preferred embodiment, the present invention is directed to a process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet of the present invention. Optionally, the transferred image may be permanently affixed to the recording sheet. It is preferred that the toner resin be a polymer containing the same monomers as the binder polymer of the recording sheet.

Examples of suitable toner resins for the process of the present invention include polyesters, such as polyester latexes, including as AQ-29D, available from Eastman Chemicals, poly(4,4-dipropoxy-2,2-diphenyl propane fumarate) #324, available from Scientific Polymer Products, poly(ethylene terephthalate) #138 and #418, available from Scientific Polymer Products, poly(ethylene succinate) #150, available from Scientific Polymer Products, poly(1,4-cyclohexane dimethylene succinate) #148, available from Scientific Polymer Products, or the like; polyvinyl acetate polymers, such as #346, #347, and #024, available from Scientific Polymer Products, or the like; vinylalcohol-vinyl acetate copolymers, such as those with a vinyl acetate content of about 91 percent by weight, including #379, available from Scientific Polymer Products, or the like; polycarbonates, such as #035, available from Scientific Polymer products, or the like; and the like, as well as mixtures thereof. In a preferred embodiment, the toner resin contains the same monomers present in the polymeric binder of the recording sheet. The resin is present in the toner in any effective amount, typically from about 10 to 95 percent by weight, preferably from about 20 to about 90 percent by weight, and more preferably from about 50 to about 70 percent by weight, although the amount can be outside these ranges.

Optionally, if it is desired to generate images that are visible with the naked eye, the toner composition can also contain a colorant. Typically, the colorant material is a pigment, although dyes can also be employed. Examples of suitable pigments and dyes are disclosed in, for example, U.S. Pat. Nos. 4,788,123, 4,828,956, 4,894,308, 4,948,686, 4,963,455, and 4,965,158, the disclosures of each of which are totally incorporated herein by reference. Specific examples of suitable dyes and pigments include carbon black, nigrosine dye, aniline blue, magnetites, and mixtures thereof, with carbon black being the most common colorant. The pigment should be present in an amount sufficient to render the toner composition highly colored to permit the formation of a clearly visible image on a recording member. Typically, the pigment particles are present in amounts of from about 1 percent by weight to about 20 percent by weight based on the total weight of the toner composition, although the amount can be outside this range.

When the pigment particles are magnetites, which comprise a mixture of iron oxides ($Fe_3O_4$) such as those commercially available as Mapico Black, these pigments are present in the toner composition in any effective amount, typically from about 10 percent by weight to about 70 percent by weight, and preferably from about 20 percent by weight to about 50 percent by weight, although the amount can be outside these ranges.

Colored toner pigments are also suitable, including red, green, blue, brown, magenta, cyan, and yellow particles, as well as mixtures thereof, wherein the colored pigments are present in amounts that enable the desired color. Illustrative examples of suitable magenta pigments include 2,9-dimethyl-substituted quinacridone and anthraquinone dye, identified in the color index as CI 60710, CI Dispersed Red 15, a diazo dye identified in the color index as CI 26050, CI Solvent Red 19, and the like. Illustrative examples of suitable cyan pigments include copper tetra-4-(octadecyl sulfonamido) phthalocyanine, copper phthalocyanine pigment, listed in the color index as CI 74160, Pigment Blue, and Anthradanthrene Blue, identified in the color index as CI 69810, Special Blue X-2137, and the like. Illustrative examples of yellow pigments that may be selected include diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Other suitable toner colorants include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG1 (Hoechst), Permanent Yellow YE 0305 (Paul Uhlich), Lumogen Yellow D0790 (BASF), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Color pigments are typically present in the toner an amount of from about 15 to about 20.5 percent by weight, although the amount can be outside this range.

The toner compositions of the present invention can also contain an optional charge control additive. Examples of suitable charge control agents are disclosed in U.S. Pat. Nos. 4,788,123, 4,828,956, 4,894,308, 4,948,686, 4,963,455, and 4,965,158, the disclosures of each of which are totally incorporated herein by reference. Specific examples of suitable charge control agents include alkyl pyridinium halides, such as cetyl pyridinium chloride, as disclosed in U.S. Pat. No. 4,298,672, the disclosure of which is totally incorporated herein by reference, cetyl pyridinium tetrafluoroborates, quaternary ammonium sulfate and sulfonate compounds, such as distearyl dimethyl ammonium methyl sulfate, as disclosed in U.S. Pat. No. 4,338,390, the disclosure of which is totally incorporated herein by reference, stearyl phenethyl dimethyl ammonium tosylates, as disclosed in U.S. Pat. No. 4,338,390, distearyl dimethyl ammonium methyl sulfate, as disclosed in U.S. Pat. No. 4,560,635, the disclosure of which is totally incorporated herein by reference, distearyl dimethyl ammonium bisulfate as disclosed in U.S. Pat. Nos. 4,937,157 and 4,560,635, the disclosures of each of which are totally incorporated herein by reference, stearyl dimethyl hydrogen ammonium tosylate, charge control agents as disclosed in U.S. Pat. No. 4,294,904, the disclosure of which is totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, and the like, as well as mixtures thereof and/or any other charge control agent suitable for dry electrophotographic toners. Additional examples of suitable charge control additives are disclosed in U.S. Pat. Nos. 4,560,635 and 4,294,904, the disclosures of each of which are totally incorporated herein by reference. Charge control agents are present in any effective amount, typically from about 0.1 to about 4 percent by weight, and more preferably from about 0.5 to about 1 percent by weight, although the amount can be outside this range.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size of from about 6 to about 20 microns.

Another method, known as spray drying, entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent.

The solvent evaporates during atomization, resulting in toner particles of a colored resin, which are then attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Other similar blending methods may also be used. Subsequent to size classification of the toner particles, any external additives are blended with the toner particles. If desired, the resulting toner composition is then mixed with carrier particles.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a colorant, and an external additive can comprise 80 percent by weight resin and 20 percent by weight colorant; the amount of external additive present is reported in terms of its percent by weight of the combined resin and colorant. External additives can include any additives suitable for use in electrostatographic toners, including straight silica, colloidal silica (e.g. Aerosil R972®, available from Degussa, Inc.), ferric oxide, Unilin (a linear polymeric alcohol comprising a fully saturated hydrocarbon backbone with at least about 80 percent of the polymeric chains terminated at one chain end with a hydroxyl group, of the general formula $CH_3(CH_2)_nCH_2OH$, wherein n is a number from about 30 to about 300, and preferably from about 30 to about 50, available from Petrolite Chemical Company), polyethylene waxes, polypropylene waxes, polymethylmethacrylate, zinc stearate, chromium oxide, aluminum oxide, stearic acid, polyvinylidene fluoride (e.g. Kynar®, available from Pennwalt Chemicals Corporation), and the like. External additives can be present in any desired or effective amount.

Dry toners can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. Nos. 3,526,533, 3,849,186, and 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

The toner is present in the two-component developer in any effective amount, typically from about 1 to about 5 percent by weight of the carrier, and preferably about 3 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. Nos. 2,618,551 and 2,618,552, the disclosures of each of which are totally incorporated herein by reference; powder cloud development is more fully described, for example, in U.S. Pat. Nos. 2,725,305, 2,918,910, and 3,015,305, the disclosures of each of which are totally incorporated herein by reference; and liquid development is more fully described, for example, in U.S. Pat. No. 3,084,043, the disclosure of which is totally incorporated herein by reference.

Liquid developers for the present invention suitable for polarizable liquid development processes can comprise a nonaqueous liquid vehicle and a colorant, which may be a dye or a pigment. When the liquid developer is intended for use in a polarizable liquid development system, the liquid developer is applied to an applicator such as a gravure roll and brought near an electrostatic latent image. The charged image polarizes the liquid developer in the depressions in the applicator, thereby drawing the developer from the depressions and causing it to flow to the image bearing member to develop the image. For this application, the liquid developer is somewhat more viscous than is the situation with electrophoretic development, since particle migration within the developer is generally not necessary and since the liquid developer must be sufficiently viscous to remain in the depressions in the applicator prior to development. The viscosity, however, remains significantly lower than that typically observed for many printing inks, since the liquid developer must be capable of being pulled from the depressions in the applicator roll by the force exerted by the electrostatic latent image. Thus, liquid developers for use in polar development systems typically have a viscosity of from about 25 to about 500 centipoise at the operating temperature of the copier or printer, and preferably from about 30 to about 300 centipoise at the machine operating temperature, although the viscosity can be outside these ranges. In addition, liquid developers intended for use in polarizable liquid development systems typically have a resistivity lower than liquid developers employed in electrophoretic development systems to enable the developer to become polarized upon entering proximity with the electrostatic latent image. Liquid developers, however, generally have resistivities that are significantly higher than the resistivities of typical printing inks, for which resistivities generally are substantially less than about $10^9$ ohm-cm. Typically, liquid developers for polarizable liquid development systems have a resistivity of from about $10^8$ to about $10^{11}$ ohm-cm, and preferably from about $2\times10^9$ to about $10^{10}$ ohm-cm, although the resistivity can be outside these ranges.

In polarizable liquid developers wherein the colorant is present directly dissolved or dispersed in the liquid vehicle, the colorant is present in any amount effective to impart to the developer the desired color and intensity. Typically, the colorant is present in the liquid developer in an amount of from about 1 to about 50 percent by weight, preferably from about 15 to about 30 percent by weight, and more preferably from about 20 to about 25 percent by weight, although the amount can be outside these ranges.

Typical liquid materials suitable as liquid vehicles for polarizable liquid developers include paraffinic and isoparaffinic hydrocarbons, such as Isopar® L, Norpar® 15, Norpar® 16, and the like, available from Exxon Corporation, mineral oil, pentadecane, hexadecane, and the like. The liquid vehicle is present in the liquid developer in a major amount, typically from about 50 to about 99 percent by weight, preferably from about 95 to about 99 percent by weight, and more preferably from about 98 to about 99 percent by weight, although the amount can be outside these ranges.

If desired, the polarizable liquid developers can also contain various polymers added to modify the viscosity of the developer or to modify the mechanical properties of the developed or cured image such as adhesion or cohesion. In particular, when the liquid developer is intended for use in polarizable liquid development processes, the developer can also include viscosity controlling agents. Examples of suitable viscosity controlling agents include thickeners such as alkylated polyvinyl pyrrolidones, such as Ganex V216, available from GAF; polyisobutylenes such as Vistanex, available from Exxon Corporation, Kalene 800, available from Hardman Company, New Jersey, ECA 4600, available from Paramins, Ontario, and the like; Kraton G-1701, a block copolymer of polystyrene-b-hydrogenated butadiene available from Shell Chemical Company, Polypale Ester 10, a glycol rosin ester available from Hercules Powder Company; and other similar thickeners. In addition, additives such as pigments, including silica pigments such as Aerosil 200, Aerosil 300, and the like available from Degussa, Bentone 500, a treated montmorillonite clay available from NL Products, and the like can be included to achieve the desired developer viscosity. Additives are present in any effective amount, typically from about 1 to about 40 percent by weight in the case of thickeners and from about 0.5 to about 5 percent by weight in the case of pigments and other particulate additives, although the amounts can be outside these ranges.

In addition, liquid developers intended for use in polarizable liquid development processes can also contain conductivity enhancing agents. For example, the developers can contain additives such as quaternary ammonium compounds as disclosed in, for example, U.S. Pat. No. 4,059,444, the disclosure of which is totally incorporated herein by reference.

Liquid developers can also comprise a nonaqueous liquid vehicle, a charge control agent, and toner particles comprising a mixture of a resin and a colorant. These liquid developers can be employed in either electrophoretic development processes or polarizable liquid development processes. When employed in polarizable liquid development processes, the developer generally has the characteristics set forth hereinabove with respect to liquid developers in which the colorant is dissolved or dispersed directly in the liquid vehicle, except that colored toner particles replace the dissolved or dispersed colorant. When the liquid developer is intended for use in electrophoretic development systems, the liquid vehicle must be capable of permitting the colored toner particles of the developer to migrate through the vehicle to develop electrostatic latent images. Thus, in electrophoretic developers, the liquid vehicle is sufficiently high in resistivity to enhance the development of particles over that of free ions, typically having a resistivity of more than about $5\times10^9$ ohm-cm and preferably more than about $10^{10}$ ohm-cm as measured by determining the average current flowing across a 1.5 millimeter gap at 5 hertz and 5 volts square wave applied potential, although the resistivity can be outside these ranges. In addition, the liquid vehicle is sufficiently low in viscosity to permit the toner particles to migrate toward the electrostatic latent image with sufficient rapidity to enable development of the image within the desired development time. Typically, the liquid vehicle has a viscosity of no more than about 20 centipoise at the operating temperature of the copier or printer, and preferably no more than about 3 centipoise at the machine operating temperature, although the viscosity can be outside these ranges.

Typical liquid materials suitable as liquid vehicles for electrophoretic liquid developers include high purity aliphatic hydrocarbons with, for example, from about 6 to about 25 carbon atoms and preferably with a viscosity of less than 2 centipoise, such as Norpar® 12, Norpar® 13, and Norpar® 15, available from Exxon Corporation, isoparaffinic hydrocarbons such as Isopar® G, H, K, L, M, and V, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like, as well as mixtures thereof. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. The liquid vehicle is present in the liquid developer in a major amount, typically from about 50 to about 99 percent by weight, preferably from about 95 to about 99 percent by weight, and more preferably from about 98 to about 99 percent by weight, although the amount can be outside these ranges.

The toner particles generally comprise colored polymeric particles, wherein the colorant is a dye or a pigment. Generally, the polymer is relatively insoluble in the liquid vehicle. Typically, the polymer is soluble in the liquid vehicle in amounts of about 5 percent by weight or less of the liquid vehicle at ambient temperature (generally from about 20° to about 30° C.). Examples of suitable polymers include ethylene-vinyl acetate copolymers such as the Elvax® I resins and Elvax 5720 resin, available from E. I. Du Pont de Nemours & Company, copolymers of ethylene and an α,β-ethylenically unsaturated acid selected from acrylic or methacrylic acid, where the acid moiety is present in an amount of from 0.1 to 20 percent by weight, such as the Nucrel® II resins and Nucrel 589 and Nucrel 960 resins, available from E. I. Du Pont de Nemours & Company, polybutyl terephthalates, ethylene ethyl acrylate copolymers such as those available as Bakelite DPD 6169, DPDA 6182 Natural, and DTDA 9169 Natural from Union Carbide Company, ethylene vinyl acetate resins such as DQDA 6479 Natural 7 and DQDA 6832 Natural 7 available from Union Carbide Company, methacrylate resins such as polybutyl methacrylate, polyethyl methacrylate, and polymethyl methacrylate, available under the trade name Elvacite from E. I. Du Pont de Nemours & Company, and others as disclosed in, for example, British Patent 2,169,416, and U.S. Pat. No. 4,794,651, the disclosures of each of which are totally incorporated herein by reference.

The colored particles can be made by any suitable process, such as by a method employing an attritor, as disclosed in, for example, U.S. Pat. Nos. 5,123,962, 5,053,306, and 5,168,022, the disclosures of each of which are totally incorporated herein by reference, or a method employing a microfluidizer, as disclosed in, for example, U.S. Pat. No. 4,783,389, the disclosure of which is totally incorporated herein by reference, or a method employing a piston homogenizer, as disclosed in copending application U.S. Ser. No. 08/098,150, filed Jul. 28, 1993, entitled "Processes for the Preparation of Developer Compositions," with the named inventors Timothy J. Fuller, James R. Larson, and Frank J. Bonsignore, the disclosure of which is totally incorporated herein by reference, or the like.

The colorant is present in the toner particles, and the toner particles are contained in the developer, in any amount effective to impart to the developer the desired color and intensity. Typically, the colorant is present in the toner particles in an amount of from about 1 to about 30 percent by weight, preferably from about 10 to about 25 percent by weight, although the amount can be outside these ranges. Typically, the toner particles are present in the liquid developer in an amount of from about 1 to about 50 percent by weight, preferably from about 1 to about 7 percent by weight, and more preferably about 2 percent by weight, although the amount can be outside these ranges.

The liquid developers of the present invention generally can be prepared by any suitable method. For example, when the liquid developer comprises a colorant dissolved or dispersed directly in the liquid vehicle, the developer can be prepared by simple mixing of the developer ingredients. When the liquid developer comprises colored polymeric particles dispersed in the liquid vehicle, the polymeric resin imbibes the colorant during the grinding process. In a typical procedure, colorant, resin, a charge control agent, and the liquid vehicle are charged into an attritor and the mixture is heated, typically to temperatures of from about 200° to about 212° F., typically for about 15 minutes. The heat source is then removed and grinding at ambient temperature is continued, typically for about 2 hours. Water cooling of the exterior of the vessel and continued grinding is then carried out, typically for about four hours, to result in particles ranging in average particle diameter of from about 1 to about 2 microns. Additional information regarding methods of preparing toner particles is disclosed in, for example, U.S. Pat. Nos. 4,476,210, 4,794,651, 4,877,698, 4,880,720, 4,880,432, 4,762,764, 3,729,419, 3,841,893, and 3,968,044, the disclosures of each of which are totally incorporated herein by reference.

The electrophoretic liquid developers can also include a charge control agent to help impart a charge to the colored toner particles. A charge control additive is generally present in the electrophoretic liquid developers of the present invention to impart to the particles contained in the liquid a charge sufficient to enable them to migrate through the liquid vehicle to develop an image. Examples of suitable charge control agents for liquid developers include the lithium, cadmium, calcium, manganese, magnesium and zinc salts of heptanoic acid; the barium, aluminum, cobalt, manganese, zinc, cerium and zirconium salts of 2-ethyl hexanoic acid, (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diisopropyl salicylate, aluminum resinate, aluminum salt of 3,5 di-t-butyl gamma resorcylic acid. Mixtures of these materials may also be used. Particularly preferred charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc with heptanoic acid; salts of barium, aluminum, cobalt, manganese, zinc, cerium, and zirconium octoates; salts of barium, aluminum, zinc, copper, lead, and iron with stearic acid; iron naphthenate; aluminum t-butyl salicylate; and the like, as well as mixtures thereof. The charge control additive may be present in an amount of from about 0.001 to about 3 percent by weight, and preferably from about 0.01 to about 0.8 percent by weight of the developer composition. Other additives, such as charge adjuvants added to improve charging characteristics of the developer, may be added to the developers of the present invention, provided that the objectives of the present invention are achieved. Charge adjuvants such as stearates, metallic soap additives, polybutylene succinimides, and the like are described in references such as U.S. Pat. Nos. 4,707,429, 4,702,984, and 4,702,985, the disclosures of each of which are totally incorporated herein by reference.

In general, images are developed with liquid electrophoretic developers and the polarizable liquid developers by generating an electrostatic latent image and contacting the latent image with the liquid developer, thereby causing the image to be developed. When a liquid electrophoretic developer is employed, the process entails generating an electrostatic latent image and contacting the latent image with the developer comprising a liquid vehicle and charged toner particles, thereby causing the charged particles to migrate through the liquid and develop the image. Developers and processes of this type are disclosed in, for example, U.S. Pat. Nos. 4,804,601, 4,476,210, 2,877,133, 2,890,174, 2,899,335, 2,892,709, 2,913,353, 3,729,419, 3,841,893, 3,968,044, 4,794,651, 4,762,764, 4,830,945, 3,976,808, 4,877,698, 4,880,720, 4,880,432, and copending application U.S. Ser. No. 07/300,395, the disclosures of each of which are totally incorporated herein by reference. When a liquid developer suitable for polarizable liquid development processes is employed, the process entails generating an electrostatic latent image on an imaging member, applying the liquid developer to an applicator, and bringing the applicator into sufficient proximity with the latent image to cause the image to attract the developer onto the imaging member, thereby developing the image. Developers and processes of this type are disclosed in, for example, U.S. Pat. Nos. 4,047,943, 4,059,444, 4,822,710, 4,804,601, 4,766,049, 4,686,936, 4,764,446, Canadian Patent 937,823, Canadian Patent 926, 182, Canadian Patent 942,554, British Patent 1,321,286, and British Patent 1,312,844, the disclosures of each of which are totally incorporated herein by reference. In both of these embodiments, any suitable means can be employed to generate the image. For example, a photosensitive imaging member can be exposed by incident light or by laser to generate a latent image on the member, followed by development of the image and transfer to a substrate. In addition, an image can be generated on a dielectric imaging member by electrographic or ionographic processes as disclosed, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, 4,485,982, 4,731,622, 3,701,464, and 4,155,093, the disclosures of each of which are totally incorporated herein by reference, followed by development of the image and, if desired, transfer to a substrate. If necessary, transferred images can be fused to the substrate by any suitable means, such as by heat, pressure, exposure to solvent vapor or to sensitizing radiation such as ultraviolet light or the like as well as combinations thereof.

U.S. Pat. No. 5,019,477, the disclosure of which is hereby totally incorporated by reference, illustrates a liquid electrostatic developer comprising a nonpolar liquid, thermoplastic resin particles, and a charge director. The ionic or zwitterionic charge directors may include both negative charge directors, such as lecithin, oil-soluble petroleum sulfonate and alkyl succinimide, and positive charge directors such as cobalt and iron naphthenates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) selected from the group consisting of vinyl toluene and styrene, and (iv) selected from the group consisting of butadiene and acrylate. A copolymer of polyethylene and methacrylic acid or methacrylic acid alkyl esters, NUCREL®, may also be selected.

U.S. Pat. No. 5,030,535, the disclosure of which is totally incorporated herein by reference, discloses a liquid developer composition comprising a liquid vehicle, a charge control additive and toner particles. The toner particles may contain pigment particles and a resin selected from the group consisting of polyolefins, halogenated polyolefins and mixtures thereof. These liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

The deposited toner image can be transferred to the recording sheet by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory electrostatic charge for transfer.

After transfer, the transferred toner image can be fixed to the recording sheet. The fixing step can be also identical to that conventionally used in electrophotographic imaging. Typical, well known electrophotographic fusing techniques include heated roll fusing, flash fusing, oven fusing, laminating, adhesive spray fixing, and the like. The fusing of toner on certain transparencies that do not contain the additives of the present invention can lead to uneven distribution of the toner on the surface of the transparency as a result of inadequate wetting of the surface by the toner. This inadequate wetting can lead to the formation of dark and light patches of toner (islands) that are not pleasant to the eye when viewed on a light projector. These islands are difficult to quantify by conventional methods, but their presence or absence can be seen visually. In the context of the present invention, the results with respect to these defects in the form of islands are presented as unacceptable when they are present and are presented as acceptable when they are absent.

The recording sheets of the present invention can also be used in any other printing or imaging process, such as printing with pen plotters, handwriting with ink pens, offset printing processes, or the like, provided that the ink employed to form the image is compatible with the ink receiving layer of the recording sheet.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Transparency sheets were prepared by a dip coating process (both sides coated in one operation) by providing Mylar® sheets (8.5×11 inches) in a thickness of 100 microns and coating them with blends of a binder resin, an additive, an antistatic agent, and a traction agent. The coated Mylar® sheets were then dried in a vacuum hood for one hour. Measuring the difference in weight prior to and subsequent to coating these sheets indicated an average coating weight of about 300 milligrams on each side in a thickness of about 3 microns. These sheets were fed into a Xerox® 1038 black only copier and into a Xerox® 5775 color copier, and images were obtained with optical densities of about 1.3 (black) in the black only copier. The black images could not be lifted off with Scotch® tape (3M). The results of the color images are presented in the table.

The recording sheet coating compositions were as follows:

1: Polyester latex (Eastman AQ 29D), 98 percent by weight; suberyl dicholine dichloride (Aldrich 86,204-5), 1 percent by weight; colloidal silica, Syloid 74, obtained from W. R. Grace & Co., 1 percent by weight.

Solids present in water solution in a concentration of 25 percent by weight.

2: Vinyl alcohol-vinyl acetate copolymer (vinyl acetate content 91 percent by weight (Scientific Polymer Products #379), 98 percent by weight; acetyl-β-methyl choline chloride, 1 percent by weight; colloidal silica, 1 percent by weight. Solids present in acetone solution in a concentration of 5 percent by weight.

3: Poly carbonate (Scientific Polymer Products #035), 98 percent by weight; D,L-carnitine hydrochloride (Aldrich C1,600-8), 1 percent by weight; colloidal silica, 1 percent by weight. Solids present in dichloromethane solution in a concentration of 5 percent by weight.

4: Polyester latex (Eastman AQ 29D), 88 percent by weight; 2,5-furandimethanol (Aldrich 19,461-1), 10 percent by weight; suberyl dicholine dichloride (Aldrich 86,204-5), 1 percent by weight; colloidal silica, Syloid 74, obtained from W. R. Grace & Co., 1 percent by weight. Solids present in water solution in a concentration of 25 percent by weight.

5: Polyester latex (Eastman AQ 29D), 83 percent by weight; 4-ethoxy phenyl acetic acid (Aldrich 12,811-2), 15 percent by weight; acetyl choline chloride (Aldrich 13,535-6), 1 percent by weight; colloidal silica, 1 percent by weight. Solids present in water solution in a concentration of 25 percent by weight.

6: Vinyl alcohol-vinyl acetate copolymer (vinyl acetate content 91 percent by weight (Scientific Polymer Products #379), 78 percent by weight; piperonylic acid (Aldrich P4,980-5), 20 percent by weight; acetyl-β-methyl choline chloride, 1 percent by weight; colloidal silica, 1 percent by weight. Solids present in acetone solution in a concentration of 5 percent by weight.

7: Vinyl alcohol-vinyl acetate copolymer (vinyl acetate content 91 percent by weight) (Scientific Polymer Products #379), 88 percent by weight; 3,4-(methylene dioxy)cinnamic acid Aldrich (14,624-2), 10 percent by weight; S-acetyl thiocholine bromide (Aldrich 85,333-2), 1 percent by weight; colloidal silica, 1 percent by weight. Solids present in acetone solution in a concentration of 5 percent by weight.

8: Poly carbonate (Scientific Polymer Products #035), 78 percent by weight; octyl gallate (Aldrich 28,962-0), 20 percent by weight; D,L-carnitine hydrochloride (Aldrich C1,600-8), 1 percent by weight; colloidal silica, 1 percent by weight. Solids present in dichloromethane solution in a concentration of 5 percent by weight.

9: Polycarbonate (Scientific Polymer Products #035), 78 percent by weight; pentamethyl cyclopentadiene-1,2,3,4,5-pentacarboxlate (Aldrich 30,284-8), 20 percent by weight; benzoyl choline chloride (Aldrich 21,697-6), 1 percent by weight; colloidal silica, 1 percent by weight. Solids present in dichloromethane solution in a concentration of 5 percent by weight.

10: Polyester latex (Eastman AQ 29D), 80 percent by weight; coumarin-3-carboxylic acid (Aldrich C8,560-3), 18 percent by weight; D,L-carnitinamide hydrochloride (Aldrich 24,783-9), 2 percent by weight. Solids present in water solution in a concentration of 25 percent by weight.

11: Vinyl alcohol-vinyl acetate copolymer (vinyl acetate content 91 percent by weight) (Scientific Polymer Products #379), 80 percent by weight; 1,2,4,5-benzene tetracarboxylic dianhydride (Aldrich 16,620-0), 14 percent by weight; Inter Pol HX42-1, 5 percent by weight; colloidal silica, 1 percent by weight. Solids present in acetone solution in a concentration of 2.5 percent by weight.

The optical densities of the images before and after the tape test were as follows:

| # | Island formation | Optical Density Before | After | % TF |
|---|---|---|---|---|
| 1 | unacceptable | 1.35 | 1.20 | 89 |
| 2 | unacceptable | 1.33 | 1.20 | 90 |
| 3 | unacceptable | 1.30 | 1.20 | 92 |
| 4 | acceptable | 1.25 | 1.25 | 100 |
| 5 | acceptable | 1.25 | 1.22 | 97.5 |
| 6 | acceptable | 1.25 | 1.21 | 97 |
| 7 | acceptable | 1.25 | 1.17 | 93.5 |
| 8 | acceptable | 1.25 | 1.20 | 96 |
| 9 | acceptable | 1.30 | 1.24 | 95.5 |
| 10 | acceptable | 1.30 | 1.26 | 97 |

As the results indicate, the transparent recording sheets coated with the blends of binder and additive exhibited toner fix of from 93.5 percent to 100 percent and no island formation. The transparency sheets without the additives exhibited a toner fix of 89 percent to 92 percent and had unacceptable island formation.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for generating images which comprises (1) generating an electrostatic latent image on an imaging member in an imaging apparatus; (2) developing the latent image; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of more than about 65° C. and a boiling point of more than about 150° C. and selected from the group consisting of (A) furan compounds; (B) pyrone and pyran compounds; (C) dioxane compounds; (D) aromatic anhydrides; (E) aromatic esters; (F) alkoxy compounds; (G) methylene dioxy compounds; (H) quinone compounds; and (I) mixtures thereof; (c) an optional filler; (d) an optional antistatic agent; and (e) an optional biocide.

2. A process according to claim 1 wherein the substrate is transparent.

3. A process according to claim 1 wherein the substrate is paper.

4. A process according to claim 1 wherein the additive is a furan compound.

5. A process according to claim 1 wherein the additive is selected from the group consisting of 3-furoic acid, 2,5-furandimethanol, furylacrylic acid, furil, furoin, 2-benzofuran carboxylic acid, 2,5-dimethyl-4-hydroxy-3(2H)-furanone, 1,3-indanedione, dibenzofuran, 1,3-diphenylisobenzofuran, 5-methoxy psoralen, 8-methoxypsoralen, 4,5',8-trimethylpsorlen, usnic acid, and mixtures thereof.

6. A process according to claim 1 wherein the additive is a pyran or pyrone compound.

7. A process according to claim 1 wherein the additive is selected from the group consisting of 3-hydroxy-2-methyl- 4-pyrone, 4-methoxy-6-methyl-2H-pyran-2-one, 6,7-dimethoxy-3-isochromanone, esculetin, 4-methylesculetin, 2,6-dimethyl-y-pyrone, 3,4-dihydro-2,2-dimethyl-4-oxo-2H-pyran-6-carboxylic acid, 3,5-diacetyl tetrahydropyran-2,4,6-trione, 4-oxo-4H-1-benzopyran-2-carboxylic acid, 2,2-dimethyl-7-ethoxy-6-methoxy-4-chromanone, 6,7-dimethoxy-2,2-dimethyl-4-chromanone, flavanone, flavone, 3-hydroxyflavone, 7-hydroxyflavone, chrysin, biochanin A, 2-carbethoxy-5,7-dihydroxy-4'-methoxyiso-flavone, α-napthoflavone, β-naphthoflavone, visnagin, trolox, 4',5'-dinitrofluorescein, coumarin, 4-hydroxycoumarin, 7-hydroxycoumarin, 7-ethoxycoumarin, 3-acetyl coumarin, coumarin-3-carboxylic acid, 7-methoxy coumarin, 7-methoxy coumarin-4-acetic acid, 5,7-dimethoxy coumarin, 6,7-dimethoxy coumarin, 6-amino-3,4-benzocoumarin, 7-hydroxy-4-methyl coumarin, 7-acetoxy-4-(bromoethyl) coumarin, 7-(carboxymethoxy)-4-methyl coumarin, 3-(α-acetonyl-4-chlorobenzyl)-4-hydroxy coumarin, 6,7-dimethoxy-4-methylcoumarin, 7,8-dihydroxy-6-methoxycoumarin, 6,7-diacetoxy-4-methylcoumarin, 4-(bromomethyl)-6,7-dimethoxycoumarin, 4,6-dimethyl-7-(ethylamino) coumarin, 3-chloro-4-methyl-7-hydroxycoumarin, [3-(α-acetonylbenzyl)-4-hydroxycoumarin, 7-hydroxy-3,4,8-trimethylcoumarin, dicumarol, and mixtures thereof.

8. A process according to claim 1 wherein the additive is a dioxane compound.

9. A process according to claim 1 wherein the additive is selected from the group consisting of 3,6-dimethyl-1,4-dioxane-2,5-dione, 2,2-dimethyl-1,3-dioxane-4,6-dione, 2,2,5-trimethyl-1,3-dioxane-4,6-dione, 2,2-dimethyl-5-phenyl-1,3-dioxane-4,6-dione, and mixtures thereof.

10. A process according to claim 1 wherein the additive is an aromatic anhydride.

11. A process according to claim 1 wherein the additive is selected from the group consisting of homophthalic anhydride, 4-methyl phthalic anhydride, 3-hydroxyphthalic anhydride, 3-nitrophthalic anhydride, 1,2,4-benzene tricarboxylic anhydride, 4-nitrophthalic anhydride, 2-phenyl glutaric anhydride, 2,3-diphenylmaleic anhydride, diphenic anhydride, 1,8-naphthalic anhydride, 4-nitro-1,8-naphthalic anhydride, 3-nitro-1,8-naphthalic anhydride, 4-bromo-1,8-naphthalic anhydride, 4-chloro-1,8-naphthalic anhydride, 1,2,4,5-benzene tetracarboxylic dianhydride, 1,4,5,8-naphthalene tetracarboxylic dianhydride, 3,3',4,4'-benzophenone tetracarboxylic dianhydride, and mixtures thereof.

12. A process according to claim 1 wherein the additive is an alkoxy compound.

13. A process according to claim 1 wherein the additive is selected from the group consisting of 3-hydroxy-4-methoxy benzaldehyde, vanillin, vanillin acetate, 5-nitrovanillin, 6-nitro veratraldehyde, 3-ethoxy-4-hydroxy benzaldehyde, syringaldehyde, syringic acid, 4-ethoxybenzoic acid, 3-methoxy-4-methylbenzoic acid, 1-(4-methoxy phenyl)-1-cyclohexane carboxylic acid, 1-(4-methoxy phenyl)-1-cyclopentane carboxylic acid, 4-ethoxy phenyl acetic acid, 3-(2-methoxy phenyl) propionic acid, 3-(4-methoxy phenyl) propionic acid, 3-ethoxy-4-methoxybenzyl alcohol, 3-hydroxy-4-methoxybenzyl alcohol, 2-ethoxy benzamide, 5-methoxy-1-tetralone, 6-methoxy-1-tetralone, 5-methoxy-1-indanone, 6-methoxy-1-indanone, 5,6-dimethoxy-1-indanone, 3-(3,4,5-trimethoxy phenyl) propionic acid, 3,4,5-trimethoxy phenyl acetonitrile, 3,4,5-trimethoxy phenyl acetic acid, 3,4,5-trimethoxy phenol, 3,4,5-trimethoxy cinnamic acid, 2,4,5-trimethoxy cinnamic acid, 3,4,5-triethoxy benzoic acid, 1,2,4-triacetoxy benzene, 3',4',5'-trimethoxy acetophenone, 3,4,5-trimethoxy aniline, 2,4,5-trimethoxy benzaldehyde, 2,4,6-trimethoxy benzaldehyde, 3,4,5-trimethoxy benzaldehyde, 2,3,4-trimethoxy benzoic acid, 2,4,5-trimethoxy benzoic acid, 3,4,5-trimethoxy benzoic acid, 2,4,6-trimethoxy benzonitrile, 3,4,5-trimethoxy benzonitrile, and mixtures thereof.

14. A process according to claim 1 wherein the additive is an ester compound.

15. A process according to claim 1 wherein the additive is selected from the group consisting of mono-methyl phthalate$_3$, monomethyl terephthalate, dimethyl terephthalate, dimethyl aminoterephthalate, methyl benzilate, octyl gallate, tyrosine methyl ester, methyl o-methyl podocarpate, ethyl 4-hydroxy-6-methyl-2-oxo-3-cyclohexene-1-carboxylate, dimethyl 1,3-cyclohexadiene-1,4-dicarboxylate, dimethyl 2,3-o-benzylidene-tartrate, trimethyl 1,3,5-benzenetricarboxylate, pentamethyl cyclopentadiene-1,2,3,4,5-pentacarboxylate, and mixtures thereof.

16. A process according to claim 1 wherein the additive is a methylene dioxy compound.

17. A process according to claim 1 wherein the additive is selected from the group consisting of 3',4'-(methylene dioxy) acetophenone, 3,4-(methylene dioxy) cinnamic acid, 3,4-(methylene dioxy)-4-nitrobenzene, 3,4-(methylene dioxy) phenylacetic acid, 6-nitropiperonal, 6-nitropiperonyl alcohol, piperonylic acid, 2,2-dihydroxy-5-methoxy-1,3-indandione, and mixtures thereof.

18. A process according to claim 1 wherein the additive is a quinone.

19. A process according to claim 1 wherein the additive is selected from the group consisting of hydroquinone, methylhydroquinone, chlorohydroquinone, phenyl hydroquinone, 2,3-dimethyl hydroquinone, 2,5-ditert-butyl hydroquinone, hydroquinone bis (2-hydroxyethyl) ether, tetrahydroxy-1,4-benzoquinone hydrate, 2,3-dimethoxy-5-methyl-1,4-benzoquinone, duroquinone, 1,2-naphthoquinone, 1,4-naphthoquinone, 2-methyl-1,4-naphthoquinone, 2,3-dimethyl-1,4-naphthaquinone, plumbagin, 5,8-dihydroxy-1,4-naphthoquinone, 2-amino-3-chloro-1,4-naphthoquinone, 2,3-dichloro-1,4-naphthoquinone, 2,3-dichloro-5,8-dihydroxy-1,4-naphthoquinine, such as anthraquinone, 1,4,4a,9a-tetrahydro anthraquinone, 2-methyl anthraquinone, 2-ethyl anthraquinone, 2-(tert-butyl) anthraquinone, 1-(methylamino) anthraquinone, 2-(hydroxy methyl) anthraquinone, anthraquinone-2-carboxylic acid, 1-chloro anthraquinone, 2-chloro anthraquinone, 1-amino anthraquinone, 1,5-dichloro anthraquinone, 1,8-dichloro anthraquinone, 1,4-diamino anthraquinone, 1,5-diamino anthraquinone, 1-amino-4-hydroxy anthraquinone, 2,6-dihydroxy anthraquinone, anthrarufin, 1-amino-4-bromo-2-methyl anthraquinone, chrysophanic acid, 6,7-dichloro-1,4-dihydroxy anthraquinone, 2,3-dimethyl quinzarin, 1,4-chrysene quinone, 5,12-naphthacenequinone, bianthrone, aceanthraquinone, and mixtures thereof.

20. A process according to claim 1 wherein the additive has a melting point of greater than about 75° C.

21. A process according to claim 1 wherein the additive has a melting point of greater than about 150° C.

22. A process according to claim 1 wherein the the electrostatic latent image is developed with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof.

23. A process according to claim 22 wherein the toner resin contains the same monomers contained in the binder on the recording sheet.

24. A recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of more than about 65° C. and a boiling point of more than about 150° C. and selected from the group consisting of (A) furan compounds; (B) pyrone and pyran compounds; (C) dioxane compounds; (D) aromatic anhydrides; (E) aromatic esters; (F) alkoxy compounds; (G) methylene dioxy compounds; (H) quinone compounds; and (I) mixtures thereof; (c) an optional filler; (d) an optional antistatic agent; and (e) an optional biocide.

25. A recording sheet which consists essentially of (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of more than about 65° C. and a boiling point of more than about 150° C. and selected from the group consisting of (A) furan compounds; (B) pyrone and pyran compounds; (C) dioxane compounds; (D) aromatic anhydrides; (E) aromatic esters; (F) alkoxy compounds; (G) methylene dioxy compounds; (H) quinone compounds; and (I) mixtures thereof; (c) an optional filler; (d) an optional antistatic agent; and (e) an optional biocide.

* * * * *